US009547319B2

(12) United States Patent
Zulim et al.

(10) Patent No.: US 9,547,319 B2
(45) Date of Patent: Jan. 17, 2017

(54) LIGHTING CONTROL DEVICE

(71) Applicant: ABL IP Holding LLC, Conyers, GA (US)

(72) Inventors: Dalibor Zulim, Conyers, GA (US); Richard L. Westrick, Jr., Social Circle, GA (US); Stephen Haight Lydecker, Snellville, GA (US)

(73) Assignee: ABL IP Holding LLC, Decatur, GA (US)

( * ) Notice: Subject to any disclaimer, the term of this patent is extended or adjusted under 35 U.S.C. 154(b) by 0 days.

(21) Appl. No.: 14/712,457

(22) Filed: May 14, 2015

(65) Prior Publication Data

US 2015/0250039 A1 Sep. 3, 2015

Related U.S. Application Data

(63) Continuation-in-part of application No. 13/596,768, filed on Aug. 28, 2012, now Pat. No. 9,041,312.

(51) Int. Cl.
*H05B 37/02* (2006.01)
*G05F 1/10* (2006.01)

(52) U.S. Cl.
CPC ..... *G05F 1/10* (2013.01); *H05B 37/0254* (2013.01)

(58) Field of Classification Search
None
See application file for complete search history.

(56) References Cited

U.S. PATENT DOCUMENTS 5,471,119 A 11/1995 Ranganath et al.
5,694,006 A * 12/1997 Konopka ..... H05B 41/28 315/219
5,925,986 A 7/1999 Moisin
6,075,326 A 6/2000 Nostwick
6,181,086 B1 * 1/2001 Katyl ..... H05B 37/0254 315/291
6,188,183 B1 2/2001 Greenwood et al.
6,337,544 B1 1/2002 Wang et al.
6,614,192 B1 * 9/2003 Noone ..... H05B 41/282 315/224
6,667,585 B2 12/2003 O'Meara et al.
6,717,374 B2 4/2004 Krummel
6,762,569 B1 7/2004 Holmes et al.
6,906,476 B1 6/2005 Beatenbough et al.
7,151,346 B2 12/2006 Sanchez et al.
7,372,216 B2 5/2008 Liang et al.
(Continued)

OTHER PUBLICATIONS

Non-Final Office Action for U.S. Appl. No. 13/596,768, mailed Oct. 22, 2014, 11 Pages.
(Continued)

*Primary Examiner* — Crystal L Hammond
(74) *Attorney, Agent, or Firm* — Kilpatrick Townsend & Stockton, LLP

(57) ABSTRACT

A lighting control device can include a control module and a processing module. The control module can provide a driving signal. The driving signal can modify a control voltage on a control interface. The control voltage can control a controllable ballast or driver. The processing module can determine a duty cycle of the driving signal. The control module and the processing module can receive power via the control interface and a power supply on the control device.

21 Claims, 28 Drawing Sheets

(56) References Cited

U.S. PATENT DOCUMENTS

| | | | | |
|---|---|---|---|---|
| 7,385,360 | B2 | 6/2008 | Dluzniak et al. | |
| 7,443,113 | B2 | 10/2008 | Crouse et al. | |
| 7,564,192 | B2 | 7/2009 | Collins et al. | |
| 7,642,735 | B2 | 1/2010 | Gulsen et al. | |
| 7,675,251 | B2 | 3/2010 | Gordin et al. | |
| 7,911,159 | B2 | 3/2011 | Van Casteren et al. | |
| 8,183,789 | B2 * | 5/2012 | Mantovani | H05B 37/0245 315/291 |
| 8,358,078 | B2 * | 1/2013 | Natarelli | H05B 41/28 315/200 R |
| 8,593,076 | B2 * | 11/2013 | Veskovic | H05B 41/295 315/200 R |
| 8,598,802 | B2 * | 12/2013 | Huang | H05B 37/0263 315/287 |
| 8,803,432 | B2 * | 8/2014 | Hausman, Jr. | H05B 41/2828 315/200 R |
| 9,041,312 | B2 | 5/2015 | Zulim et al. | |
| 2002/0158591 | A1 * | 10/2002 | Ribarich | H05B 37/0254 315/291 |
| 2003/0127998 | A1 | 7/2003 | Notarianni et al. | |
| 2004/0119423 | A1 | 6/2004 | Yablonowski et al. | |
| 2008/0150451 | A1 | 6/2008 | Gordin et al. | |
| 2008/0258637 | A1 * | 10/2008 | Leung | H05B 33/0851 315/185 R |
| 2009/0184662 | A1 * | 7/2009 | Given | H05B 33/0815 315/294 |
| 2009/0206775 | A1 | 8/2009 | Green et al. | |
| 2010/0039048 | A1 * | 2/2010 | Liu | H05B 41/2828 315/307 |
| 2010/0148681 | A1 * | 6/2010 | Kuo | H05B 33/0818 315/193 |
| 2010/0213859 | A1 * | 8/2010 | Shteynberg | H05B 33/0815 315/224 |
| 2010/0237804 | A1 | 9/2010 | Liang et al. | |
| 2010/0301751 | A1 * | 12/2010 | Chobot | H05B 33/0815 315/86 |
| 2011/0057570 | A1 | 3/2011 | Cleland et al. | |
| 2011/0057573 | A1 | 3/2011 | Jutras et al. | |
| 2011/0121754 | A1 * | 5/2011 | Shteynberg | H05B 33/0815 315/294 |
| 2011/0291576 | A1 * | 12/2011 | Wong | H05B 33/0815 315/210 |
| 2012/0043899 | A1 * | 2/2012 | Veskovic | H05B 41/295 315/200 R |
| 2012/0074860 | A1 * | 3/2012 | Lee | H03K 4/501 315/240 |
| 2012/0286681 | A1 * | 11/2012 | Hausman, Jr. | H05B 41/2828 315/200 R |
| 2013/0127362 | A1 * | 5/2013 | Trainor | G01R 31/44 315/224 |
| 2013/0193879 | A1 * | 8/2013 | Sadwick | H05B 33/0818 315/307 |
| 2014/0062338 | A1 * | 3/2014 | Zulim | H05B 37/0254 315/307 |
| 2015/0115809 | A1 * | 4/2015 | Siessegger | H05B 33/0803 315/185 R |
| 2015/0303687 | A1 * | 10/2015 | Yseboodt | H02J 1/00 307/31 |

OTHER PUBLICATIONS

Response to Non-Final Office Action for U.S. Appl. No. 13/596,768, filed Dec. 30, 2014, 12 pages.

Notice of Allowance for U.S. Appl. No. 13/596,768, mailed Jan. 28, 2015, 8 pages.

* cited by examiner

LIGHTING CONTROL DEVICE

CROSS-REFERENCE TO RELATED APPLICATIONS

This application is a continuation-in-part of U.S. patent application Ser. No. 13/596,768 filed Aug. 28, 2012 and titled "Lighting Control Device," now allowed, the contents of which are hereby incorporated by reference.

FIELD OF THE INVENTION

This disclosure relates generally to control devices and more particularly relates to control devices powered from a control interface.

BACKGROUND

Currently available control systems for lighting devices, such as luminaires, include those controllers that support a 0-10 volts ("V") analog control protocol. Currently available control systems are not powered via a control interface, such as a 0-10 V control bus used to provide a control voltage or control signal to, for example, a control input of a controllable ballast or driver for a luminaire. Currently available control systems include additional power sources for powering the components of the control system, thereby increasing the cost and complexity of lighting control systems.

Control systems for lighting devices can also include methods and devices to compensate for lumen depreciation in lighting devices. Lumen depreciation is the reduction of light output over the lifespan of the lighting device. For example, luminaires can reduce light output by 20% or more over their useful lifespan. Previous methods and devices designed to compensate for lumen depreciation may require the incorporation of additional specialized equipment, such as optical or electrical sensors or dedicated external equipment requiring a separate power supply of some kind. The incorporation of additional specialized equipment can increase the costs and complexity involved with compensating for lumen depreciation.

SUMMARY

In some aspects, a lighting control device is provided. The lighting control device can include a control module and a processing module. The control module can provide a driving signal. The driving signal can modify a control voltage on a control interface. The control voltage can control a controllable ballast or driver. The processing module can determine a duty cycle of the driving signal. The control module and the processing module can receive power via the control interface.

These and other aspects, features and advantages of the present invention may be more clearly understood and appreciated from a review of the following detailed description and by reference to the appended drawings and claims.

DETAILED DESCRIPTION

Figure 1:
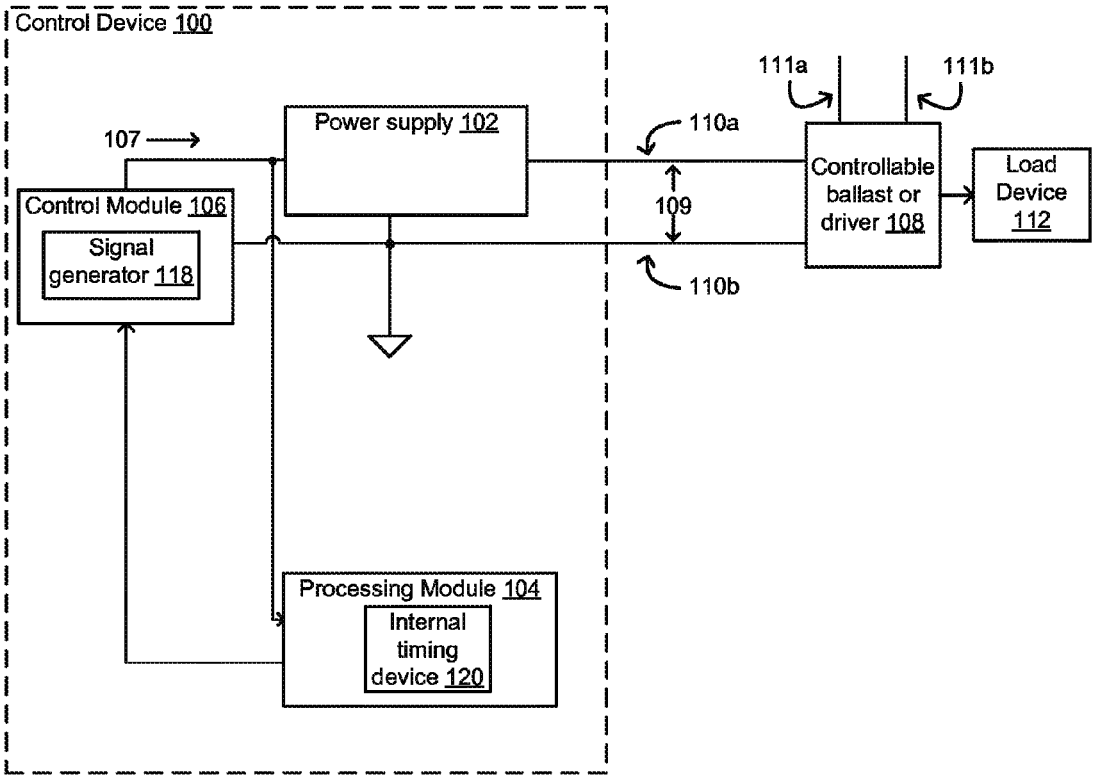
FIG. 1 is a block diagram illustrating an example lighting control device.

Aspects of the present invention provide a lighting control device, also referred to herein as a control device. The lighting control device can include a power supply, a control module, and a processing module. The power supply can provide a control voltage via a control interface, such as 0-10V control bus, to a controllable ballast or driver. The controllable ballast or driver can power a lighting device, such as a lamp or LEDs. The control module can provide a driving signal to the power supply. The driving signal can cause the power supply to load and thereby modify the control voltage on the 0-10 V control bus or other control interface. The processing module can determine a duty cycle of the driving signal. The power supply can provide a regulated, constant voltage for the processing module (e.g., 3.3 V or 5.0 Vdc) from the 0-10 V analog control voltage, thereby obviating the need for a dedicated power supply to provide power to the control device.

For example, the control device can include a regulating device, such as a voltage regulator, for providing a constant voltage to a microprocessor directly from a 0-10 V analog control bus. The constant voltage can be, for example, 3.3 Vdc or 5.0 Vdc. The microprocessor can provide a pulse-width modulation ("PWM") signal to the output of the voltage regulator. The PWM signal can modulate the average sink current at the output of the voltage regulator, thereby modifying the analog voltage level on the 0-10 V control bus. A controllable ballast or driver can be current limited. For example, the American National Standards Institute ("ANSI") standard for lamp ballasts C82.11 specifies a current limit range from 10 microamps to 2 milliamps provided by a controllable ballast. Modulating the load current across the output of the voltage regulator can control the current sinking by the voltage regulator based on the duty cycle of the PWM signal. Modifying the sinking of current can modify a control voltage on the control bus.

A controllable ballast or driver can measure the analog voltage level on the control bus or other control interface. The controllable ballast or driver can modify or control an amount of power delivered to a lamp or other lighting device based on the analog voltage level on the control bus. The relationship between the 0-10 V control voltage and light output from the lamp can be linearly proportional. A dimming curve can be predefined in a memory device of the controllable ballast or driver such that the control voltage and the light output from the lamp or other lighting device satisfy user expectations.

These illustrative examples are given to introduce the general subject matter discussed herein and are not intended to limit the scope of the disclosed concepts. The following sections describe various additional aspects and examples with reference to the drawings in which like numerals indicate like elements.

The features discussed herein are not limited to any particular hardware architecture or configuration. A computing device can include any suitable arrangement of components that provide a result conditioned on one or more inputs. Suitable computing devices include multipurpose microprocessor-based computer systems accessing stored software that programs or configures the computing system from a general-purpose computing apparatus to a specialized computing apparatus implementing one or more aspects of the present subject matter. Any suitable programming, scripting, or other type of language or combinations of languages may be used to implement the teachings contained herein in software to be used in programming or configuring a computing device.

FIG. 1 illustrates an example control device 100 for controlling a controllable ballast or driver 108. The control device 100 can include a power supply 102, a processing module 104, and a control module 106.

The control device 100 can modify an analog control voltage 109 (indicated by a bidirectional arrow) across leads 110*a*, 110*b* of a control interface, such as a 0-10 V control bus. For example, the lead 110*a* can be connected to the positive lead on a 0-10 V control interface (e.g., a violet wire) and the lead 110*a* can be connected to the negative lead on the 0-10 V control interface (e.g., a gray wire).

The analog control voltage 109 can be modified to configure the controllable ballast or driver 108. Configuring the controllable ballast or driver 108 can include modifying the output voltage provided by the controllable ballast or driver 108 based on the control voltage 109. For example, a control voltage 109 can be provided on the control bus ranging from a sum of the regulated output voltage of the power supply 102 and a minimum drop-out voltage of a specific power regulator of the power supply 102 to ten volts (e.g., 4.3 Vdc to 10 Vdc). The power or current provided to a load device 112, such as a lamp or other lighting device, from the controllable ballast or driver 108 can be adjusted proportionally with the control voltage 109. For example, an analog control voltage 109 of five volts can cause the controllable ballast or driver 108 to provide 50% of its full output power to a load device 112, such as a lamp or other lighting device.

A non-limiting example of a controllable ballast or driver 108 is a dimming ballast. The controllable ballast or driver 108 can be powered via input power leads 111*a*, 111*b*. The input power leads 111*a*, 111*b* can be respectively connected to, for example, a hot line and neutral line, a 120 V line and a neutral line, or a 277 V line and a neutral line. The output voltage, output current, or output power provided by the controllable ballast or driver 108 can be modified by any suitable mechanism, such as (but not limited to) phase dimming, current regulation, voltage regulation, power regulation, pulse-width modulation, and the like. The controllable ballast or driver 108 can provide power to a load device 112. Non-limiting examples of a load device 112 can include lighting devices, such as LEDs, HID lamps, and fluorescent lighting sources. In some aspects, the control device 100, the controllable ballast or driver 108, and the load device 112 can be included in a single device or be coupled to a single printed circuit board.

The control voltage 109 can be modified by the control module 106. The control module 106 can include a signal generator 118. The signal generator 118 can provide a driving signal 107 (as indicated by the rightward arrow) to the power supply 102. The driving signal 107 can cause the control voltage 109 to change. In some aspects, the signal generator 118 can be a PWM signal generator configured to provide a PWM signal, as discussed in detail below with respect to FIG. 2. In other aspects, the signal generator 118 can be a digital-to-analog converter of a microprocessor configured to provide an analog voltage for controlling the loading on a 0-10 V control bus.

The processing module 104 can configure the control module 106. The processing module 104 can include any suitable device or group of devices configured to execute code stored on a computer-readable medium. Examples of processing module 104 include a microprocessor, a mixed signal microcontroller, an application-specific integrated circuit ("ASIC"), a field-programmable gate array ("FPGA"), or other suitable processor. The processing module 104 can determine a frequency for the driving signal 107 provided by a signal generator 118 of the control module 106. The processing module 104 can configure the signal generator 118 to provide the driving signal 107 with the determined frequency.

The control device 100 can receive power via a connection to the leads 110*a*, 110*b* of the control interface. Powering the control device 100 via the connection to the leads 110*a*, 110*b* of a control interface such as a 0-10 V control bus can obviate the need for a separate power supply to provide power to the control device 100.

The processing module 104 can operate at a full power or other operational mode during periods of time when the control module 106 is being configured. The processing module 104 can operate in a "sleep" or other low power mode during other periods of time. The internal timing device 120 can be used to activate the processing module 104 for configuring the control module 106. Activating the processing module 104 can include switching the processing module 104 from a "sleep" or other lower power mode to a full power or other operational mode. Non-limiting examples of an internal timing device 120 can include a watch crystal oscillator, an internal very-low-power low-frequency oscillator, and an internal digitally controlled oscillator.

In some aspects, the processing module 104 can be set to a "sleep" or other low power mode for the majority of the operational lifespan of the control device 100. The processing module 104 can be set to an operational mode to latch the output of the control module 106 to a high state or a low state and determine a duty cycle for the driving signal 107. In additional or alternative aspects, the processing module 104 can read additional inputs, such as the control voltage 109 at the output of the power supply 102, to determine the duty cycle. Non-limiting examples of additional inputs may include a temperature measured by a temperature sensing device or an external switch that might be used for bi-level control. The processing module 104 can return to a sleep mode upon latching the control module 106 to a high state or a low state. The control module 106 can continue to generate a driving signal 107 as the processing module is in a sleep mode. Operating the processing module 104 in a "sleep" or other low power mode can reduce the amount of power that the control device 100 receives from the control interface.

The control device 100 can consume a sufficiently low amount of current from a control bus such that the control voltage is not affected. For example, if the controllable ballast or driver 108 is sourcing 100 microamps at 10 V, the average current consumption of the control device 100 may not exceed 10 microamps at 10 V maximum output voltage on the control bus. In another example, if the control device 100 consumes 60 microamps such that the analog control voltage is regulated at 5.0 Vdc, the controllable ballast or driver 108 can control the lamp output at 50% light output.

Figure 2:
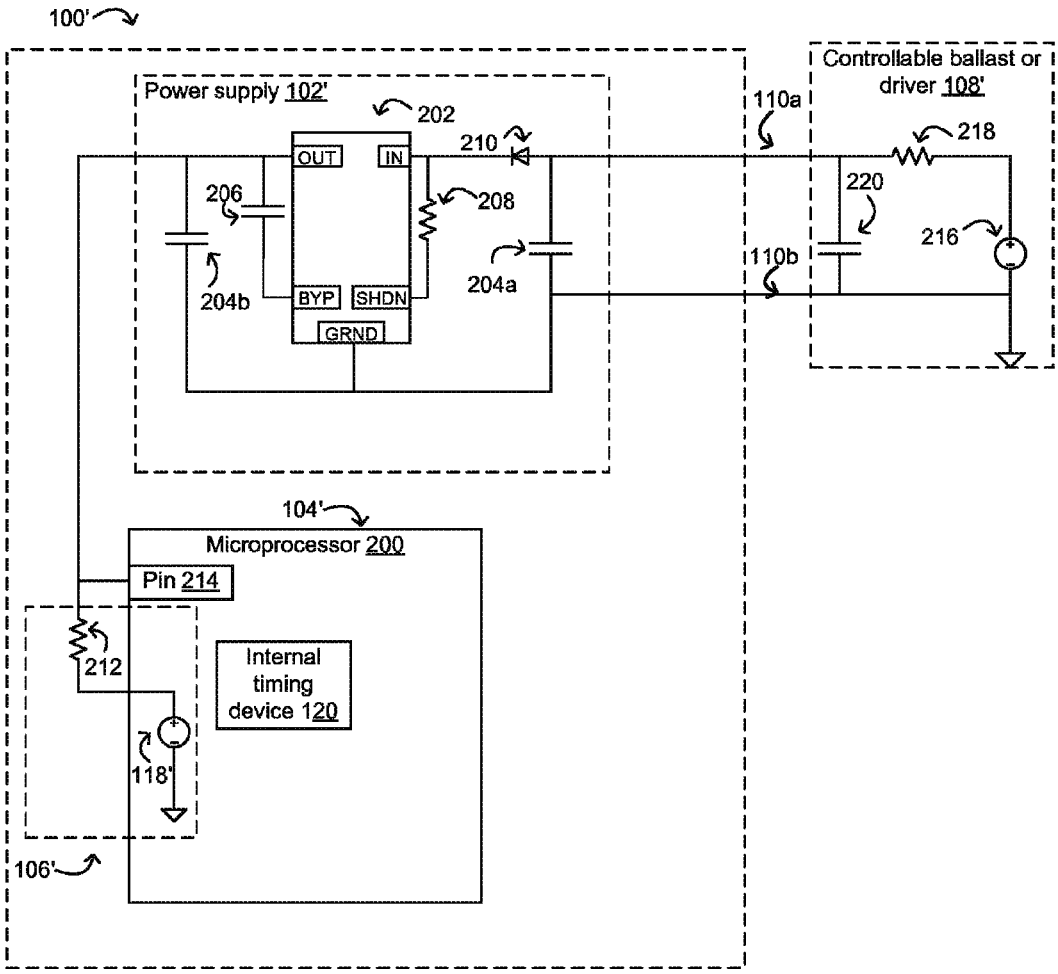
FIG. 2 is a schematic diagram illustrating the example lighting control device.

An example of a control device 100' is illustrated in the schematic diagram of FIG. 2. The control device 100' can include the power supply 102' and a microprocessor 200 that includes a processing module 104' and a control module 106'. The control device 100' can configure a controllable ballast or driver 108', such as a voltage source 216 in series with an R-C network including a resistor 218 and a capacitor 220.

The power supply 102' can include a regulator device 202, holdup capacitors 204*a*, 204*b*, and a blocking diode 210. The regulating device 202 can regulate power, current, or voltage. The regulator device 202 can step down an analog control voltage 109 provided via a control interface, such as a 0-10 V control bus. For example, a voltage of 10 V from the control interface can be stepped down to 3.3 V on the output of the regulator device 202. The voltage on the output of the regulator device 202 can power the microprocessor 200. A non-limiting example of the regulator device 202 is a low noise micro-power regulator, such as an LT® 1761 100 mA low noise micro-power regulator or a Texas Instruments® TPS75133 low-dropout regulator. A resistor 208 can couple the shutdown pin ("SHDN") of the regulator device 202 to the input pin ("IN") of the regulator device 202, thereby disabling the shutdown pin. A bypass capacitor 206 can couple the output pin ("OUT") to the bypass pin ("BYP"), thereby lowering the noise on the output voltage at the output pin. The blocking diode 210 can prevent a reverse current flow into the control bus and controllable ballast or driver 108. Other non-limiting examples of a regulator device 202 can include a voltage regulator, a linear regulator, a switched-mode power supply, or a low power regulator.

The microprocessor 200 can be any suitable low power microprocessor, such as (but not limited to) a Texas Instruments® MSP430G2231. In some aspects, the microprocessor 200 can be powered by a voltage of 0.8 V to 5.0 V. The power supply 102' can provide a regulated, constant voltage to the microprocessor 200. The voltage provided to the microprocessor 200 can be, for example, 3.3 Vdc or 5.0 Vdc. As depicted in FIG. 2, power from the control interface can be provided to the microprocessor 200 via an output pin of the regulator device 202 that is connected to a power pin 214 of the microprocessor 200.

The control module 106' can include a PWM signal generator 118' in series with a resistor 212. The PWM signal generator 118' can provide a driving signal 107 to the power supply 102'. The driving signal 107 can modulate the control voltage 109 provided by the power supply 102' via PWM.

Modulating the control voltage 109 via PWM can include providing a driving signal 107 switching between an "ON" and "OFF" state. A longer duration of the "ON" state can correspond to a higher duty cycle for the driving signal 107. The duty cycle of the PWM signal generator 118' can include a ratio of the duration of an "ON" state to the total period of the driving signal 107. Modulating the control voltage 109 using the driving signal 107 can cause current from the holdup capacitors 204*a*, 204*b* to sink. The sinking of current from the holdup capacitors 204*a*, 204*b* can modify the control voltage 109 at the output of the power supply 102'. For example, sinking 50 microamps of current can result in a control voltage 109 of 6 V and sinking 60 microamps of current can result in a control voltage 109 of 5.5 V. Modifying the duty cycle of the driving signal 107 modulating the control voltage 109 can modify the amount of current sinking, thereby modifying the control voltage 109 provided to the controllable ballast or driver 108'.

Figure 3:
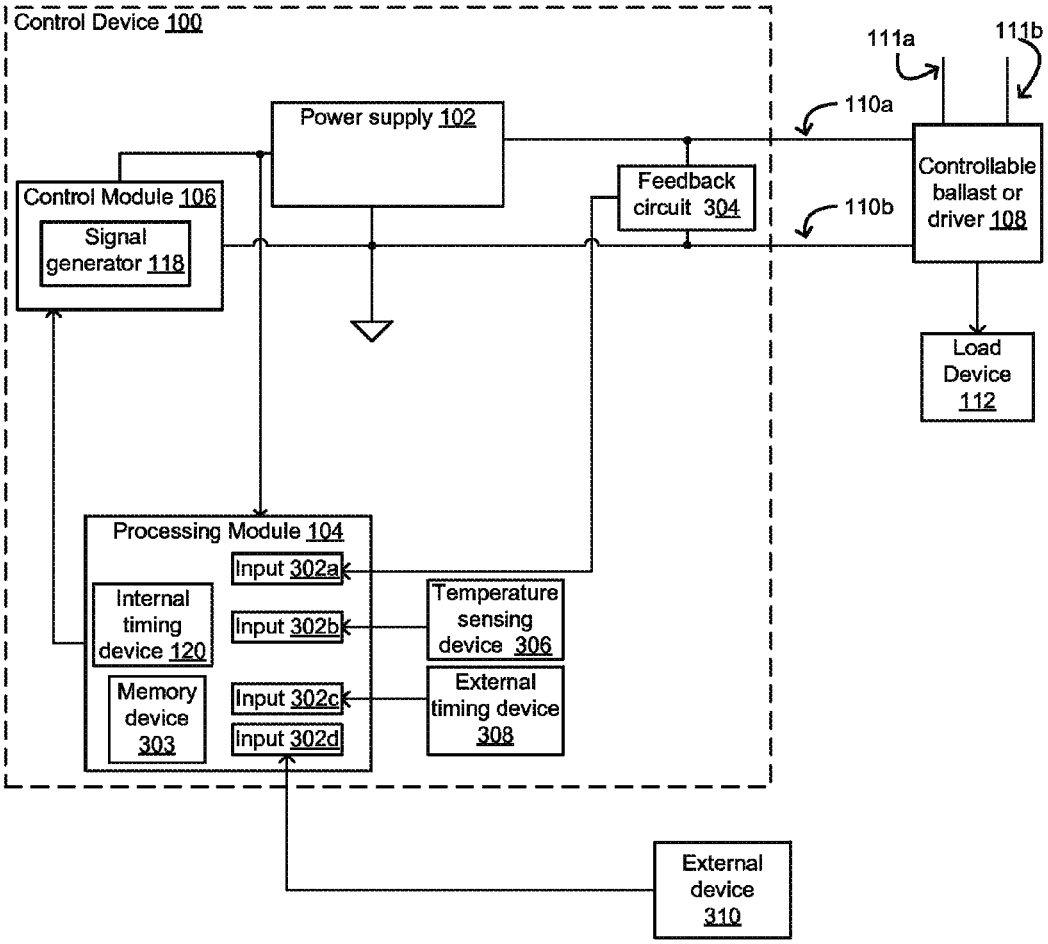
FIG. 3 is a block diagram illustrating an example lighting control device including additional devices for determining the duty cycle of a driving signal.
Figure 4:
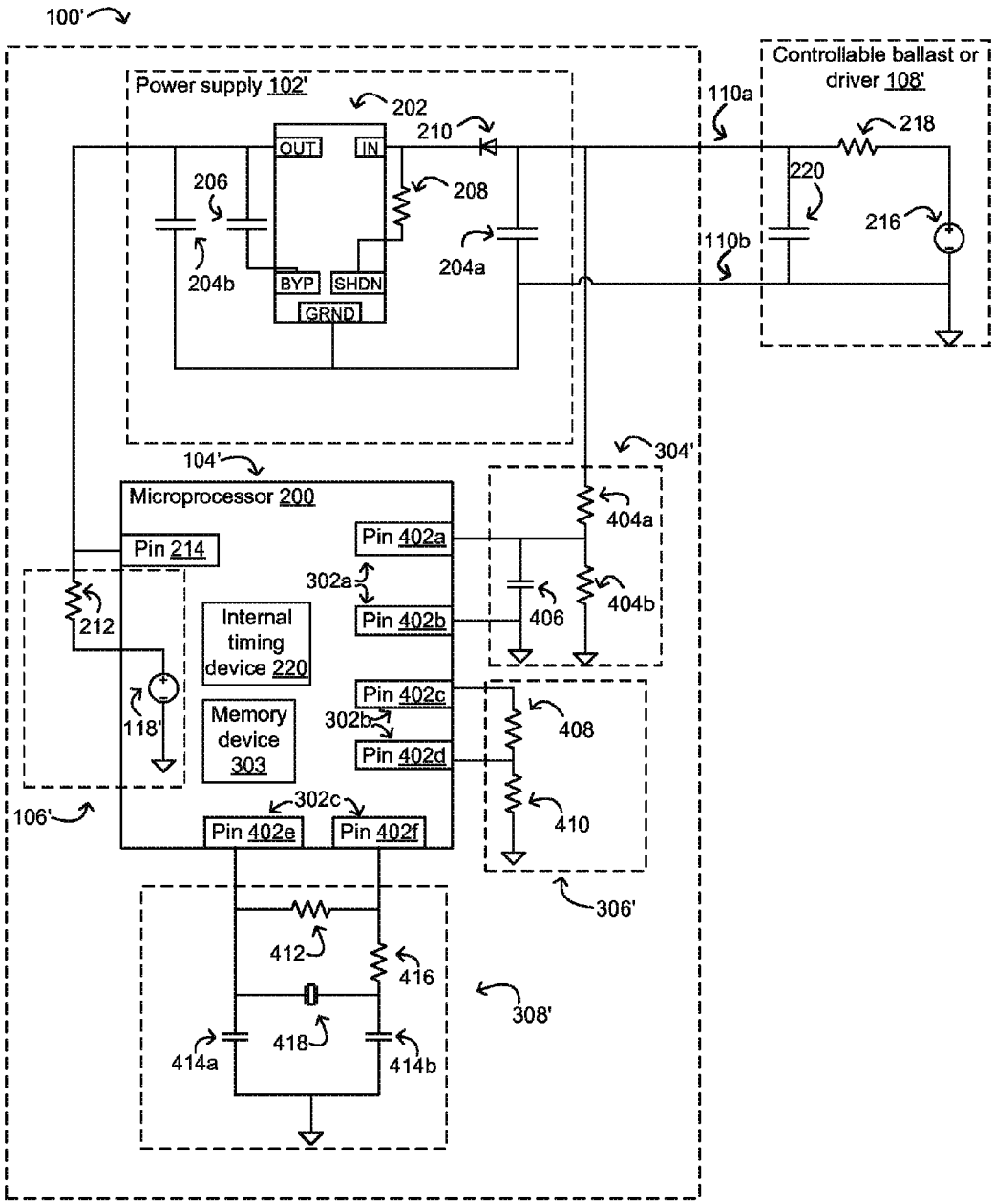
FIG. 4 is a schematic diagram illustrating the example lighting control device including additional devices.

In additional or alternative aspects, the processing module 104 can select the duty cycle of the driving signal 107 based on one or more optional inputs from additional devices. FIG. 3 is a block diagram depicting the control device 100 receiving input from additional devices such as a feedback circuit 304, a temperature sensing device 306, an external timing device 308, and an external device 310 separate from the control device 100. FIG. 4 is a schematic diagram depicting example implementations of such devices.

As depicted in FIG. 3, the processing module 104 can include inputs 302*a-d*. The inputs 302*a-d* can be respectively coupled to one or more of the feedback circuit 304, the temperature sensing device 306, the external timing device 308, and the external device 310. Although FIG. 3 depicts the control device 100 coupled to all of the feedback circuit 304, the temperature sensing device 306, the external timing device 308, and the external device 310, the control device 100 can be coupled to any number of such devices (including none).

The feedback circuit 304 depicted in FIG. 3 can be used by the processing module 104 to monitor the control voltage 109 regulated by the control device 100. The processing module 104 can measure the control voltage 109 via the feedback circuit 304. The processing module 104 can determine whether the control voltage 109 differs from a target control voltage. The target control voltage can be stored in a computer-readable medium included in or accessible by the processing module 104. The processing module 104 can modify the duty cycle of the driving signal 107 such that control voltage 109 matches the target control voltage.

A non-limiting example of feedback circuit 304' is schematically depicted in FIG. 4. The feedback circuit 304' can include resistors 404*a*, 404*b* and a capacitor 406. The input 302*a* can include the pins 402*a* of the microprocessor 200. The pin 402*a* can be, for example, an ADC input pin of the microprocessor 200. The pin 402*b* can provide a ground connection for the microprocessor 200. The microprocessor 200 can read the target control voltage from a memory device 303. The microprocessor 200 can compare the target control voltage from the memory device 303 to the sampled voltage on the pin 402*a*. The microprocessor 200 can configure the PWM signal generator 118' to adjust the PWM duty cycle based on the difference between the target voltage and the sampled voltage on the pin 402*a*.

The temperature sensing device 306 depicted in FIG. 3 can be used by the processing module 104 to monitor the ambient temperature of the control device 100. The temperature sensing device 306 can be coupled to the processing module 104 via the input 302*b*. A non-limiting example of a temperature sensing device 306' is schematically depicted in FIG. 4. The temperature sensing device 306' can include a thermistor 408 and a voltage divider resistor 410. The microprocessor 200 can monitor a temperature by providing a voltage to thermistor 408 and the voltage divider resistor 410.

Although the temperature sensing device 306 is depicted in FIG. 3 as internal to the control device 100, the temperature sensing device 306 may additionally or alternatively be an external device connected to the control device 100 via an input 302*b*. An external temperature sensing device can be used to measure the ambient temperature or direct temperature of the controllable ballast or driver 108 or a load device 112, such as a lamp or other lighting device.

The external timing device 308 depicted in FIG. 3 can provide an accurate clock signal used for real time clock monitoring. The external timing device (crystal or oscillator) can provide a clock signal used by a microcontroller to operate and calculate the real time. Non-limiting examples of an external timing device 308 can include a watch crystal oscillator, a very-low-power low-frequency oscillator, and a digitally controlled oscillator. The external timing device 308 can also be used to update the internal timing device 120. In some aspects, the external timing device 308 can use less power than internal timing device 120, thereby allowing a wider dimming range.

A non-limiting example of an external timing device 308' is schematically depicted in FIG. 4. The external timing device 308' can be a real time crystal oscillator that includes a crystal 418, such as (but not limited to) an ECS-3X8 crystal, connected to ground via the capacitors 414*a*, 414*b*. The real time crystal oscillator can also include a feedback resistor 412 and a series resistor 416. The external timing device 308' can be used as a reference for the internal timing device 120 for monitoring the operating time of the fixture. The external timing device 308' can be coupled to the microprocessor 200 via an input 302*c* such as pins 402*e*, 402*f*. Non-limiting examples of the pins 402*e*, 402*f* can include a timing input pin, such as the "XIN" pin of a microcontroller, and a timing output pin, such as the "XOUT" pin of a microcontroller.

In additional aspects, the control device 100 can use one or more of the operating time, ambient temperature, or data provided by the external device 310 to compensate for lumen depreciation in a load device 112 that is a lighting device. For example, luminaires having light emitting diodes ("LED", high-intensity discharge ("HID") lamps, and fluorescent lighting sources can reduce light output by 20% or more over their useful lifespan. The controllable ballast or driver 108 can provide additional power to a load device 112 to compensate for lumen depreciation. A compensating control voltage can be provided to the controllable ballast or driver 108 to configure the controllable ballast or driver 108 to provide the additional power. The processing module 104 of the control device 100 can determine the compensating control voltage using one or more of the operating time, ambient temperature, or data provided by the external device 310, thereby increasing the power provided to the load device 112.

The operating time for the control device 100 can be used by the processing module 104 to determine the compensating control voltage outputted by the power supply 102 and an appropriate duty cycle for the driving signal 107 provided by the control module 106. The compensating control voltage can increase in relation to the operating time for the control device 100. For example, the processing module 104 can select a duty cycle sufficient to configure the power supply 102 to provide a control voltage of 8.2 V at 10,000 operating hours and a control voltage of 9.3 V at 50,000 operating hours.

The control device 100 can increase the control voltage 109 over time to compensate for lumen depreciation in a load device 112 that is a lighting device. A device profile specific to the load device 112 can be stored in a memory device included in or accessible by the control device 100. The device profile can include an estimated lumen depreciation over time for a given lighting device. The processing module 104 can access the device profile and determine a compensating control voltage based on the device profile and the operating time. In some aspects, the control device 100, controllable ballast or driver 108, and load device 112 can be included in a low power lighting system. The low power lighting system can thus provide a continuous light output level for the expected lifetime of the load device 112.

The temperature sensing device 306 can be used to provide additional information regarding lumen depreciation. For example, the lumen depreciation for a load device 112 that is a lighting device can differ based on the ambient temperature or the temperature of components of the load device 112. For environments in which the control device 100 and the load device 112 have similar ambient temperatures, the processing module 104 can determine a target control voltage for the power supply 102 based on the ambient temperature detected by the temperature sensing device 306. The control device 100 can increase the control voltage 109 to compensate for lumen depreciation based on the ambient temperature exceeding a threshold temperature.

In additional or alternative aspects, an external device 310 that is a temperature sensor disposed in the load device 112 can be used to provide the ambient temperature or the temperature of components of the load device 112. The processing module 104 can determine a target control voltage for the power supply 102 based on the temperature provided by the external device 310. The control device 100 can increase the control voltage 109 to compensate for lumen depreciation based on the temperature exceeding a threshold temperature.

In additional or alternative aspects, an external device can be a second control device, such as (but not limited to) a 0-10 V analog control dimmer. The second control device can be connected to the controllable ballast or driver 108 in parallel with the control device 100. The second control device can allow the output of the controllable ballast or driver 108 to be manually controlled.

Figure 5:
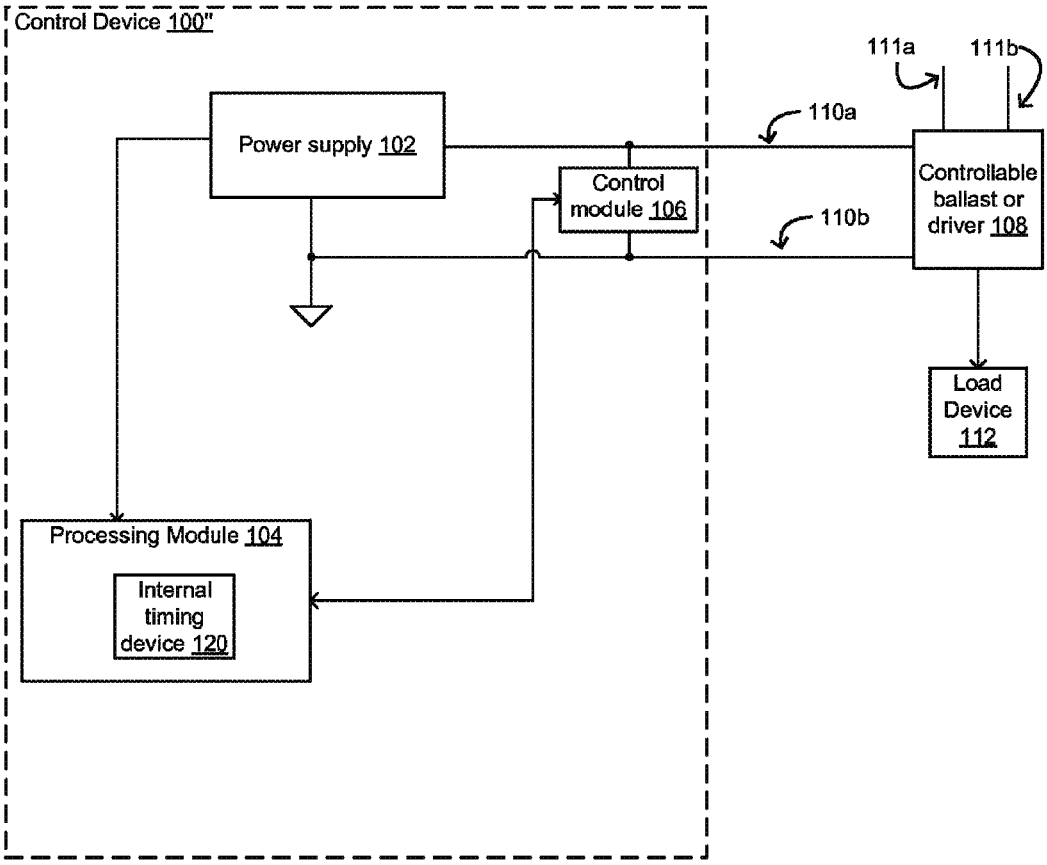
FIG. 5 is a block diagram illustrating an alternate example of a lighting control device.

In additional or alternative aspects, the control module 106 can be positioned at the input of the power supply 102. FIG. 5 depicts a block diagram of a control device 100" having a control module 106 positioned at the input of the power supply 102. The control module 106 can modify the control voltage 109 that is used to control the power output to the load device 112 provided by the controllable ballast or driver 108.

Figure 6:
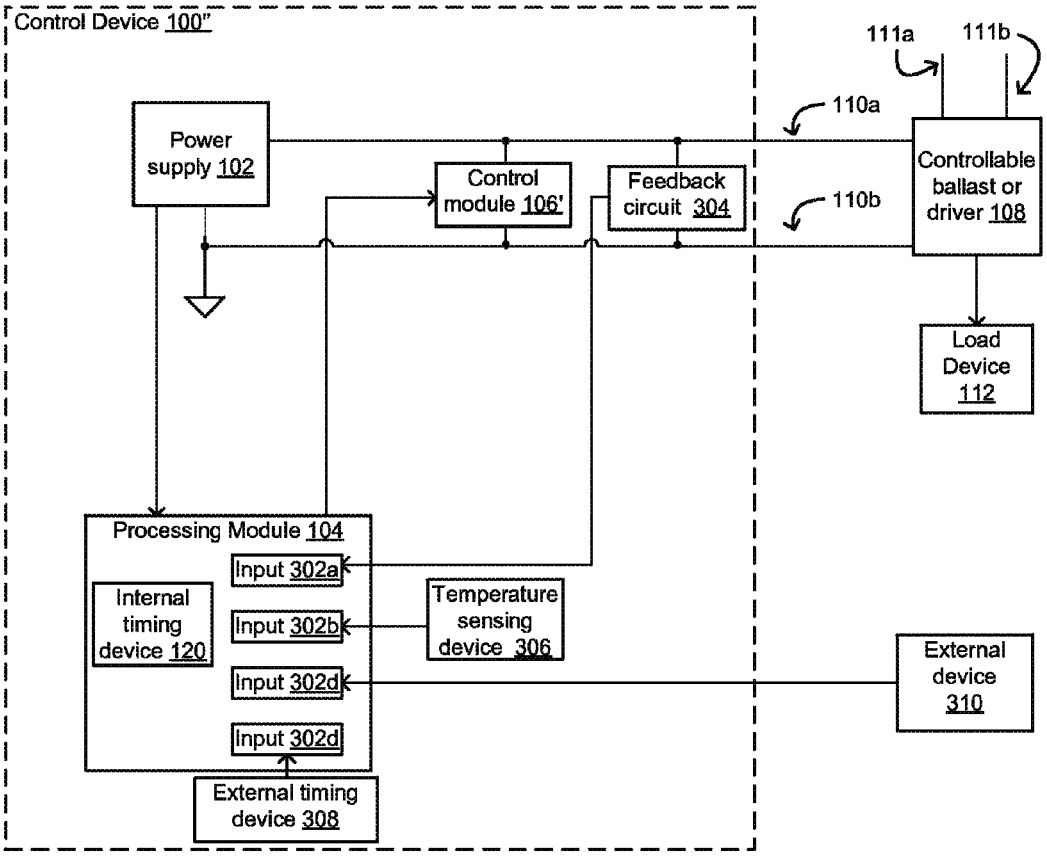
FIG. 6 is a block diagram illustrating the alternate lighting control device including additional devices.

In additional or alternative aspects, the control device 100" can include additional devices. For example, FIG. 6 depicts a control device 100" having the feedback circuit 304, the temperature sensing device 306, the external timing device 308, and the external device 310. Non-limiting examples of the feedback circuit 304, the temperature sensing device 306, the external timing device 308 depicted in FIG. 6 can respectively include the feedback circuit 304', the temperature sensing device 306', the external timing device 308' depicted in FIG. 4.

Figure 7:
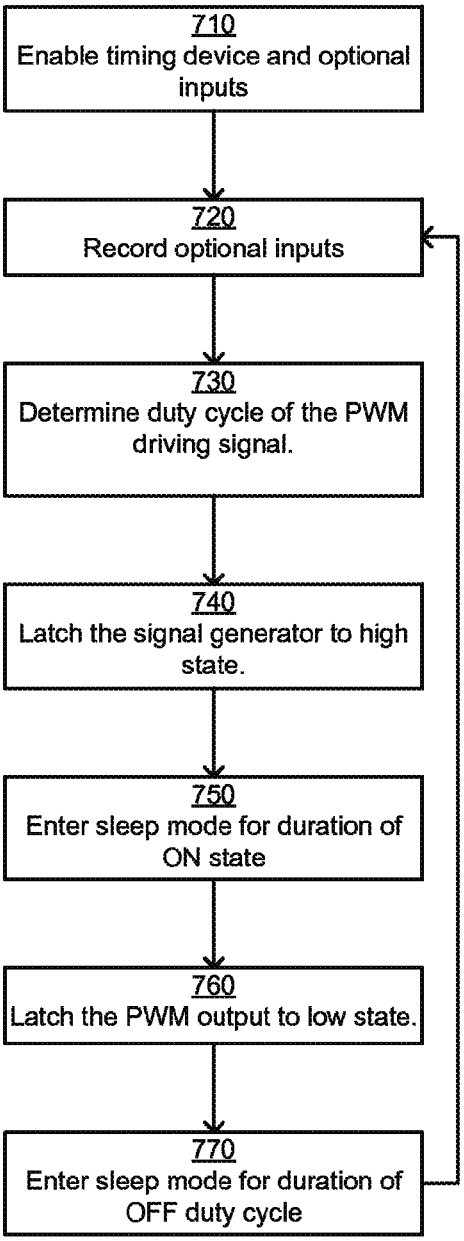
FIG. 7 is a flow chart illustrating an example method of determining the duty cycle of a driving signal generated by a control module of the lighting control device.

The processing module 104 can iteratively determine a duty cycle for the driving signal 107 based on data provided by or generated from the additional devices included in or connected to the control device 100. FIG. 7 is a flow chart illustrating an example method 700 of determining the duty cycle of a driving signal 107 provided by the control module 106. For illustrative purposes, the method 700 is described with reference to the system implementation depicted in FIGS. 1-4. Other implementations, however, are possible.

The exemplary method 700 involves enabling a timing device and one or more of the inputs 302*a-d* of the control device 100, as shown in block 710. The timing device can be the internal timing device 120. In additional aspects, the external timing device 308 can also be enabled.

The exemplary method 700 further involves recording one or more of the inputs 302*a-d* to the memory device 303, as shown in block 720. The processing module 104 can record the inputs 302*a-d*. The one or more inputs 302*a-d* can include data received by or determined using the feedback circuit 304, the temperature sensing device 306, and the external device 310. The inputs 302*a-d* can be used to implement features such as lumen depreciation compensation and real operation time duration.

The exemplary method 700 further involves determining the duty cycle of the driving signal 107 provided by the control module 106, as shown in block 730. The processing module 104 can determine the duty cycle of the driving signal 107. Determining the duty cycle of the driving signal 107 can include calculating the duration of the ON state of a driving signal 107 provided by the signal generator 118 of the control module 106. A non-limiting example of the driving signal 107 is a PWM driving signal generated by a PWM signal generator 118'. The processing module 104 can determine the duty cycle based on the inputs 302*a-d*. In additional or alternative aspects, the processing module 104 can determine the duty based on a look-up table of target control voltages provided by the power supply 102. Latch the PWM output to high state.

The exemplary method 700 further involves latching the output of the signal generator 118 to a high state, as shown in block 740. The processing module 104 can communicate a control signal to the control module 106. The control module 106 can latch the signal generator 118 to a high state in response to receiving the control signal from the processing module 104.

The exemplary method 700 further involves the processing module 104 entering a sleep or other low-power mode for the duration of the ON state, as shown in block 750. Entering the sleep or other low-power mode can conserve power used by the control device 100. The internal timing device 120 and/or the external timing device 308 can cause the processing module 104 to exit the sleep or other low-power mode and enter an operational mode after the duration of the ON state.

The exemplary method 700 further involves latching the output of the signal generator 118 to a low state, as shown in block 760. The processing module 104 can communicate a control signal to the control module 106. The control module 106 can latch the signal generator 118 to a low state in response to receiving the control signal from the processing module 104.

The exemplary method 700 further involves the processing module 104 entering a sleep or other low-power mode for the duration of the OFF state, as shown in block 770. Entering the sleep or other low-power mode can conserve power used by the control device 100. The internal timing device 120 and/or the external timing device 308 can cause the processing module 104 to exit the sleep or other low-power mode and enter an operational mode after the duration of the OFF state. The method 700 can return to block 720 to determine the duty cycle for the driving signal 107.

FIGS. 8-27 depict various additional or alternative aspects of a lighting control device. Any implementation of a lighting control device that is described above with respect to FIGS. 1-7 can include one or more of the features described below with respect to FIGS. 8-27. For example, in some aspects, higher voltage control signals from an external control device can be used to generate lower voltage signals (e.g., signals with an amplitude less than or equal to 3.3 volts) that can be used by a low-power processing module 104.

Figure 8:
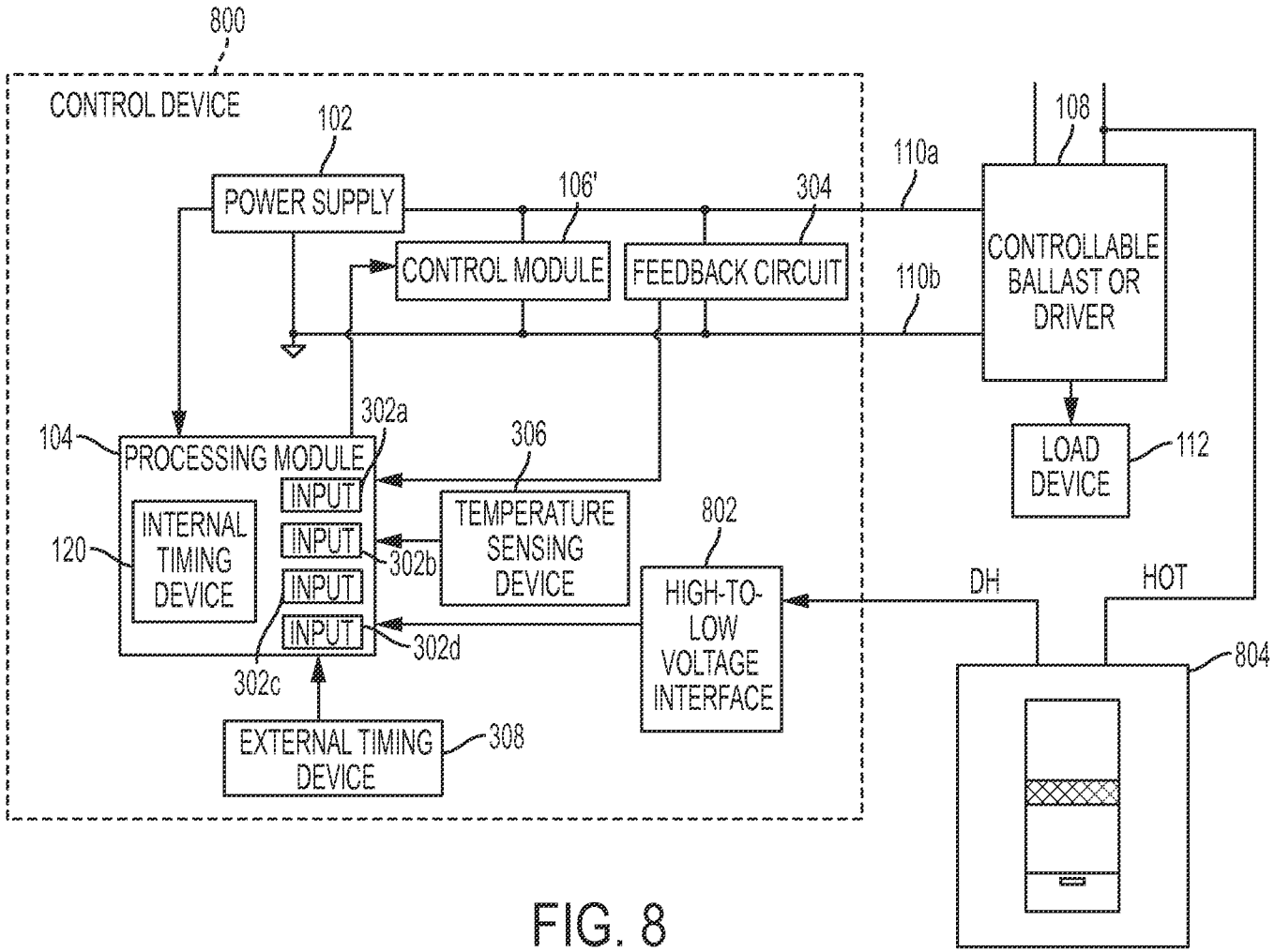
FIG. 8 is a block diagram illustrating an example of a lighting control device that can be used with a phase dimmer device.

FIG. 8 is a block diagram illustrating an example of a lighting control device 800 that can be used with a phase dimmer device 804. The lighting control device 800 can be implemented using any aspects of the lighting control device 100 described above with respect to FIGS. 1-7. For example, the lighting control device 800 depicted in the example of FIG. 8 includes a power supply 102, a processing module 104, a control module 106, and a feedback circuit 304, each of which can perform the same or similar functions as described above with respect to FIGS. 1-7. Other implementations, however, are possible.

The phase dimmer device 804 can receive power via a hot wire (labeled "HOT" in FIG. 8) and can output dimming signals via a dimmed hot wire (labeled "DH" in FIG. 8). The dimming signals can include data indicating desired operations for lighting devices (e.g., increasing illumination, decreasing illumination, etc.). The phase dimmer device 804 can output dimming signals at higher voltages (e.g., 120 V, 277 V, etc.) than the lighting control device 800 may be capable of using. For example, the processing module 104 may be implemented using a low-voltage microprocessor rated for a lower power operation than the phase dimmer device 804.

The lighting control device 800 depicted in FIG. 8 includes a high-to-low voltage interface 802. The high-to-low voltage interface 802 can allow the lighting control device 800 to receive data from the phase dimmer device 804. The high-to-low voltage interface 802 can convert a dimming signal (which is outputted by the phase dimmer device 804 at a voltage that may be too high for use by the processing module 104) to a lower voltage signal that can be used by the processing module 104. The high-to-low voltage interface 802 can be electrically coupled to the processing module 104 via an input 302*c* (as depicted in FIG. 8) or any other suitable input. The low-voltage signal outputted from the high-to-low voltage interface 802 can be provided to the processing module 104 via the input 302*c* or any other suitable input.

The processing module 104 can use the low-voltage signal in any suitable manner, as described above with respect to the external device 310 depicted in FIG. 3. For example, the control device 800 can modify a control voltage across leads 110*a*, 110*b* based on a signal derived from the dimming signal, which is received from the phase dimmer device 804. The derived signal can be a low voltage signal corresponding to the dimming signal that is received from the phase dimmer device 804. Correspondence between the low voltage signal and the dimming signal can involve, for example, the low voltage signal having a waveform similar to the dimming signal.

Figure 9:
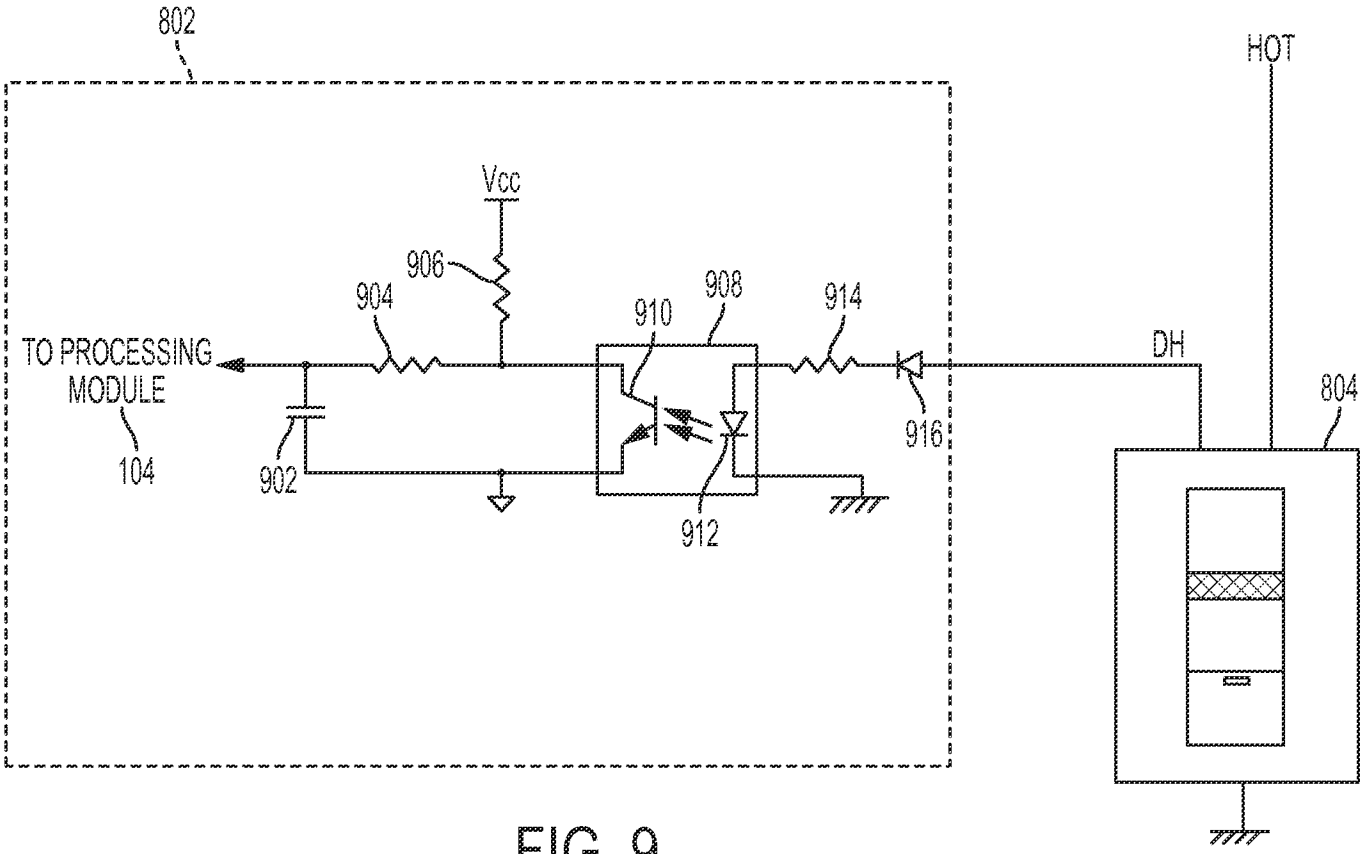
FIG. 9 is a partial schematic diagram illustrating an example of the high-to-low voltage interface of the lighting control device depicted in FIG. 8.

FIG. 9 is a partial schematic diagram illustrating an example of the high-to-low voltage interface 802. The high-to-low voltage interface 802 can include a filter capacitor 902, a filter resistor 904, a pull-up resistor 906, an opto-coupler 908 with a phototransistor 910 and a light-emitting diode 912, a current-limiting resistor 914, and a blocking diode 916.

The opto-coupler 908 can communicatively couple the processing module 104 to the phase dimmer device 804. The opto-coupler 908 can also provide electrical isolation between the phase dimmer device 804 and the processing module 104. For example, the light-emitting diode 912 can emit light in response to a current (e.g., a dimming signal) from the phase dimmer device 804 passing through the light-emitting diode 912. The emitted light can selectively activate the phototransistor 910 (or another suitable photosensor) such that a current flows through the phototransistor 910. The current flowing through the phototransistor 910 can have a waveform that is similar to or otherwise corresponds to the dimming signal from the phase dimmer device 804. The waveform of the current flowing through the phototransistor 910 can provide data to the processing module 104 that is the same as or similar to data encoded in the dimming signal outputted by the phase dimmer device 804.

The opto-coupler 908 is depicted for purposes of illustration only. Other implementations are possible. Other examples of a coupling component or circuit include a magnetic coupling circuit, a transformer, an inductive coupler, a capacitive coupler, etc.

The pull-up resistor 906 can be coupled to a suitable power supply (labeled "VCC" in FIG. 9) such that the waveform of the generated signal is at a sufficiently high voltage level for use by the processing module 104.

An RC filter that includes the filter capacitor 902 and the filter resistor 904 can filter a signal that the high-to-low voltage interface 802 generates or otherwise derives from the phase dimmer device 804. The RC filter can reduce or eliminate high-frequency noise or other desirable signal components from the derived signal.

The implementation of the high-to-low voltage interface 802 depicted in FIG. 9 is provided for purposes of illustration. Other implementations are possible. For example, the high-to-low voltage interface 802 can include any circuitry suitable for converting a high-voltage waveform received from the phase dimmer device 804 into a low-voltage waveform that can be used by the processing module 104.

Figure 10:
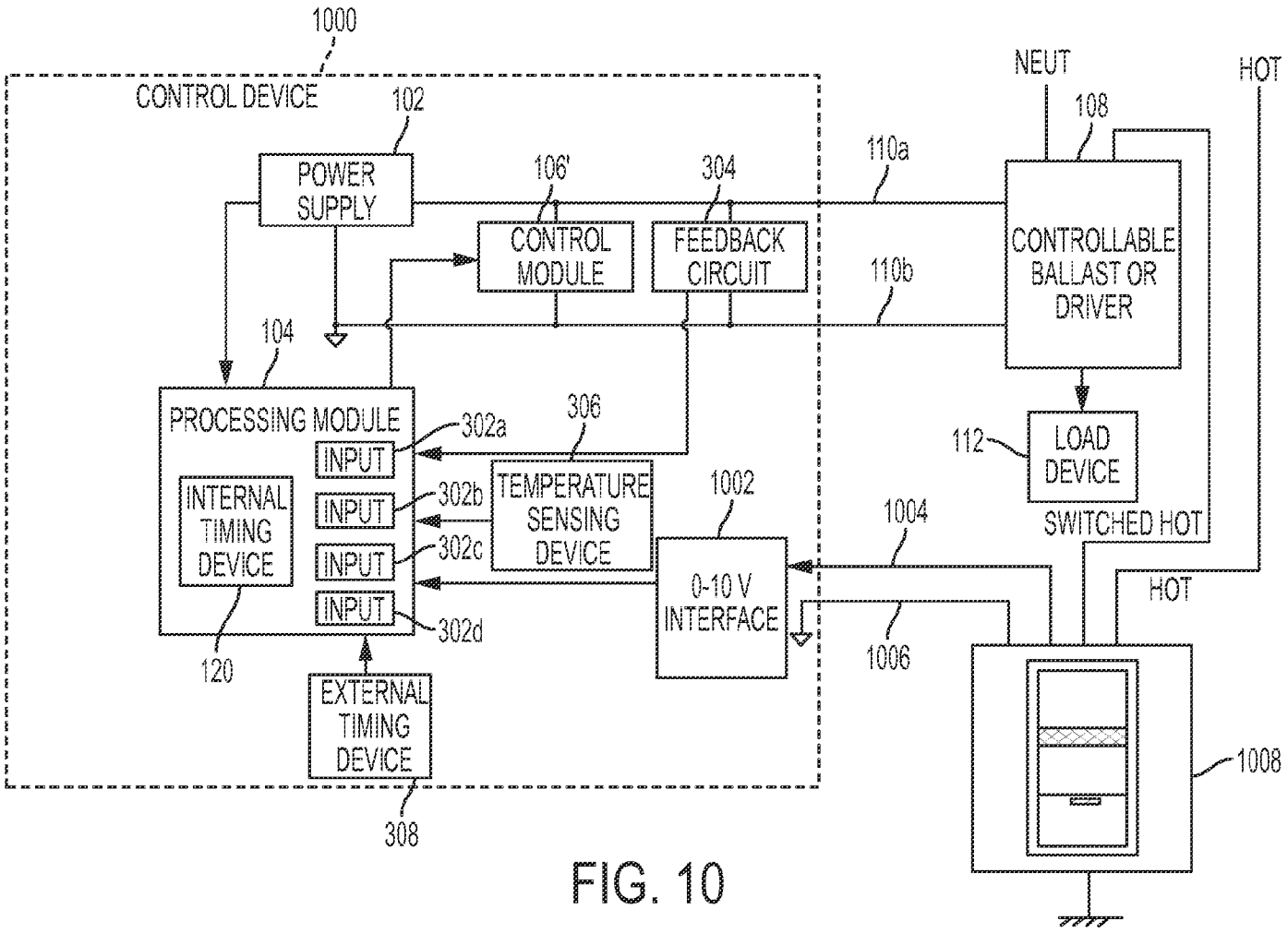
FIG. 10 is a block diagram illustrating an example of a lighting control device that can be used with a 0-10 V dimmer device.

In additional or alternative aspects, other external dimming devices can be used by a lighting control device. For example, FIG. 10 is a block diagram illustrating an example of a lighting control device 1000 that can be used with a 0-10 V dimmer device 1008. The lighting control device 1000 can be implemented using any aspects of the lighting control device 100 described above with respect to FIGS. 1-7. Other implementations, however, are possible.

The lighting control device 1000 can be electrically coupled to the 0-10 V dimmer device 1008 via a 0-10 V interface 1002. The 0-10 V interface 1002 can be connected to wires 1004, 1006 (e.g., purple and gray wires) that provide a 0-10 V interface. The 0-10 V dimmer device 1008 can be rated for lower voltages than, for example, a phase dimmer device 804. The lower voltages used by the 0-10 V dimmer device 1008 may be too high for use by a processing module 104. The 0-10 V interface 1002 can be used to decrease the voltage of a signal waveform outputted by the 0-10 V dimmer device 1008 to a lower voltage level that is usable by the processing module 104. The control device 1000 can modify a control voltage across leads 110*a*, 110*b* based on the low-voltage signal.

Figure 11:
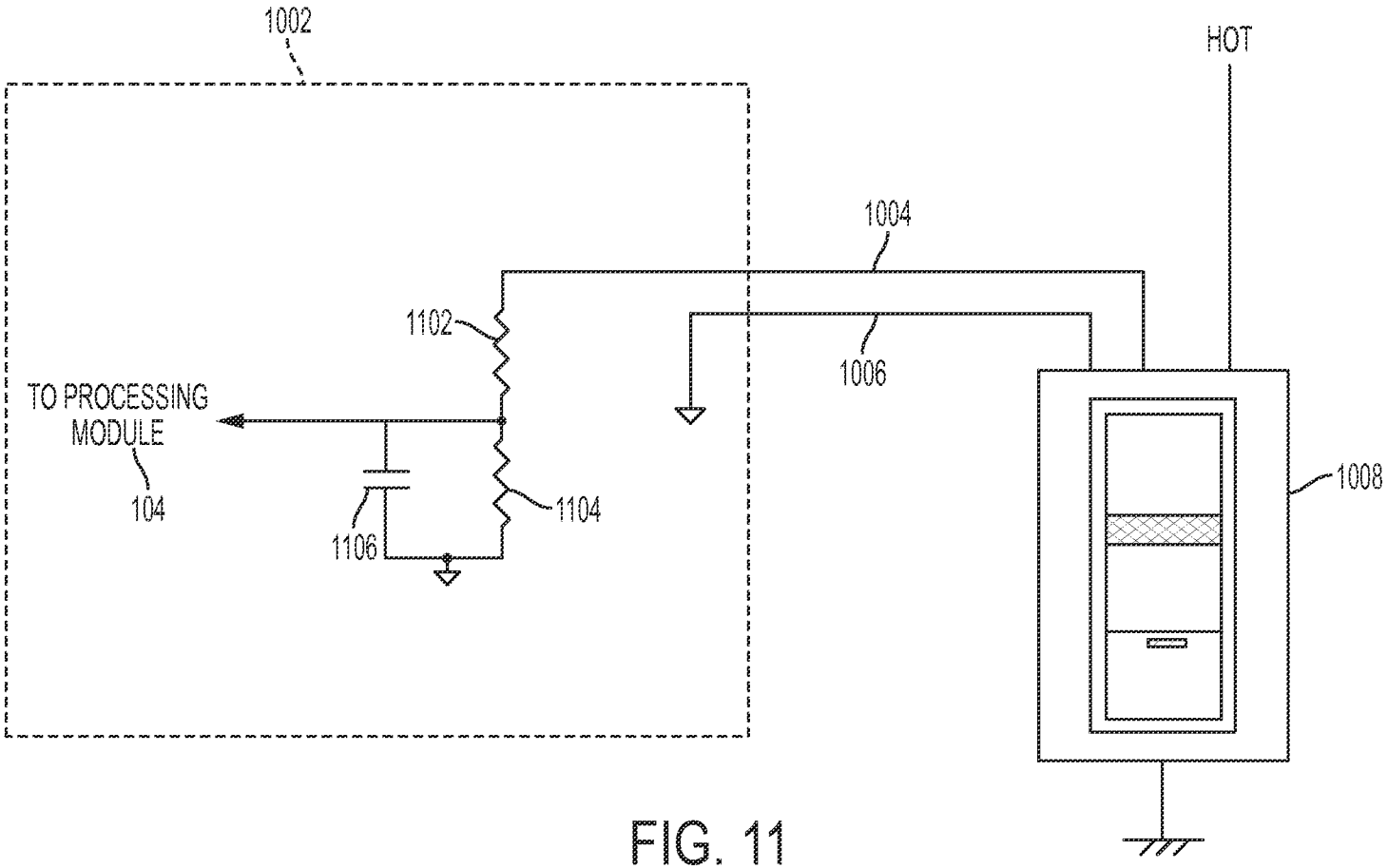
FIG. 11 is a partial schematic diagram illustrating an example of the 0-10 V interface of the lighting control device depicted in FIG. 10.

FIG. 11 is a partial schematic diagram illustrating an example of the 0-10 V interface 1002 of the lighting control device 1000. The 0-10 V interface 1002 can include resistors 1102, 1104 that provide a voltage divider. The 0-10 V interface 1002 can also include a filter capacitor 1106.

A voltage drop provided by the voltage divider can decrease the voltage of the signal received from the from the 0-10 V dimmer device 1008. An electrical connection from the input 302*c* (or another suitable input of the processing module 104) to the voltage divider at a point between the resistors 1102, 1104 can be used to provide the resulting low-voltage signal to the processing module 104. The filter capacitor 1106 can provide suitable filtering for the low-voltage signal. For example, the filter capacitor 1106 can reduce high-frequency noise or other undesirable signal components of the low-voltage signal.

The implementation of the 0-10 V interface 1002 depicted in FIG. 11 is provided for purposes of illustration. Other implementations are possible. The filter interface can include any circuitry suitable for converting a high-voltage waveform from the 0-10 V dimmer device 1008 into a low-voltage waveform that can be used by the processing module 104. For example, the 0-10 V interface 1002 can be implemented in the same manner as the high-to-low voltage interface 802 depicted in FIG. 9 (e.g., using a coupling component that provides communicative coupling and electrical isolation form the 0-10 V dimmer device 1008).

Figure 12:
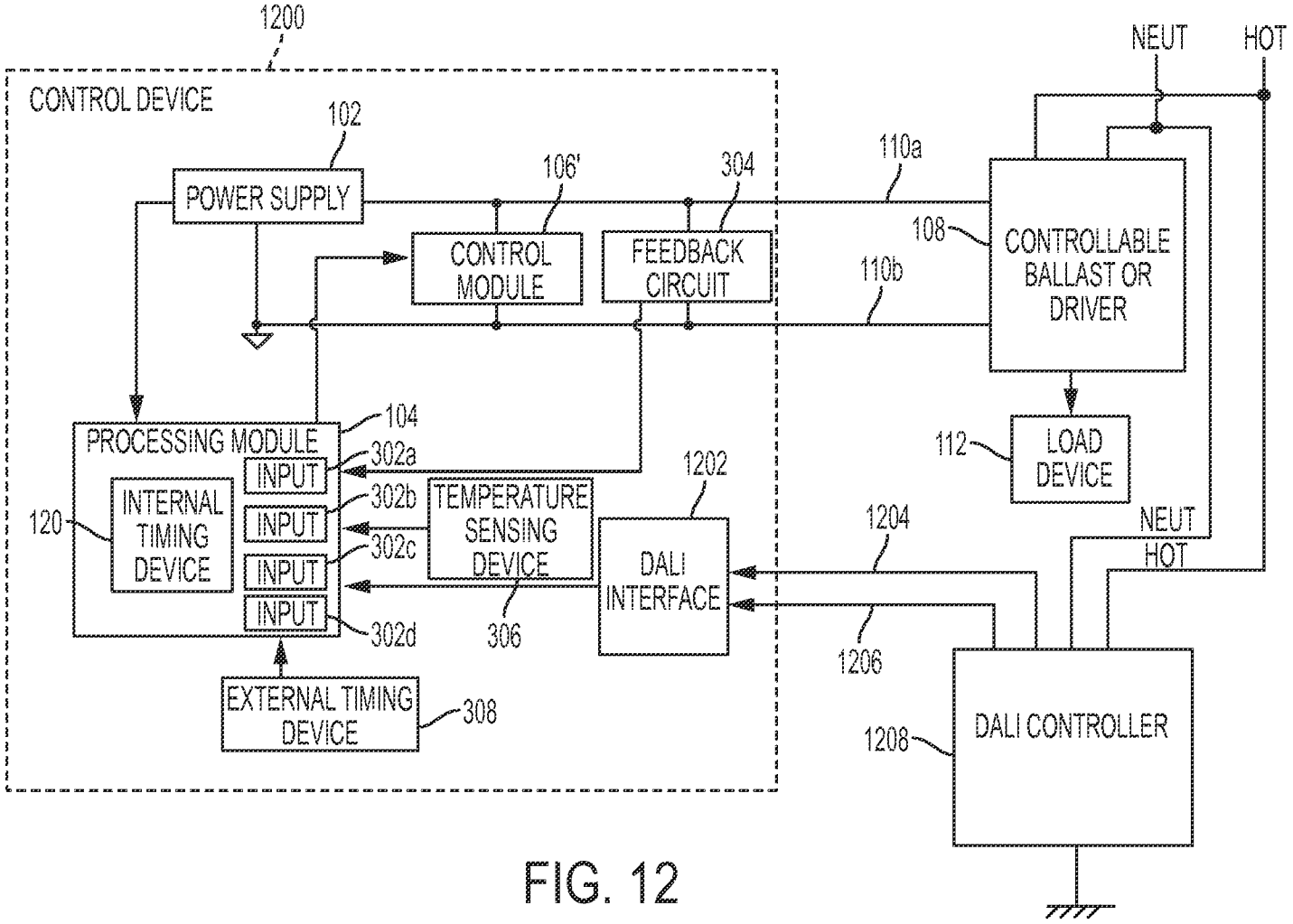
FIG. 12 is a block diagram illustrating an example of a lighting control device that can be used with a Digital Addressable Lighting Interface ("DALI") controller.

In additional or alternative aspects, other external control devices can be used with a lighting control device. For example, FIG. 12 is a block diagram illustrating an example of a lighting control device 1200 that can be used with a Digital Addressable Lighting Interface ("DALI") controller 1208. The lighting control device 1200 can be implemented using any aspects of the lighting control device 100 described above with respect to FIGS. 1-7. Other implementations, however, are possible.

The lighting control device 1200 depicted in FIG. 12 includes a DALI interface 1202 that allows the lighting control device 1200 to receive data from the DALI controller 1208. The DALI controller 1208 can be powered using connections to hot and neutral wires (labeled "HOT" and "NEUTRAL" in FIG. 12). The DALI controller 1208 can output signals formatted using the DALI protocol via wires 1204, 1206 that form a network bus to communicate with the lighting control device 1200.

The DALI interface 1202 can convert a control signal (which is outputted by the DALI controller 1208 at a voltage that may be too high for use by the processing module 104) to lower voltage signal that can be used by the processing module 104. For example, the DALI controller 1208 may output signals using signal levels of 0 V±4.5 V to indicate a "0" and 16 V±6.5 V to indicate a "1." The DALI interface 1202 can convert the DALI signals at these higher voltage levels to signals that use lower voltages (e.g., 2.8 V, 3.3 V, etc.) suitable for the processing module 104.

The DALI interface 1202 can be electrically coupled to the processing module 104 via input 302*c*, as depicted in FIG. 12, or any other suitable input to the processing module 104. The low-voltage signal outputted from the DALI interface 1202 can be provided to the processing module 104 via the input 302*c* or other suitable input. The processing module 104 can use the low-voltage signal in any suitable manner, as described above with respect to the external device 310 depicted in FIG. 3. For example, the processing module 104 can modify a control voltage across the leads 110*a*, 110*b* based on the low-voltage signal.

Figure 13:
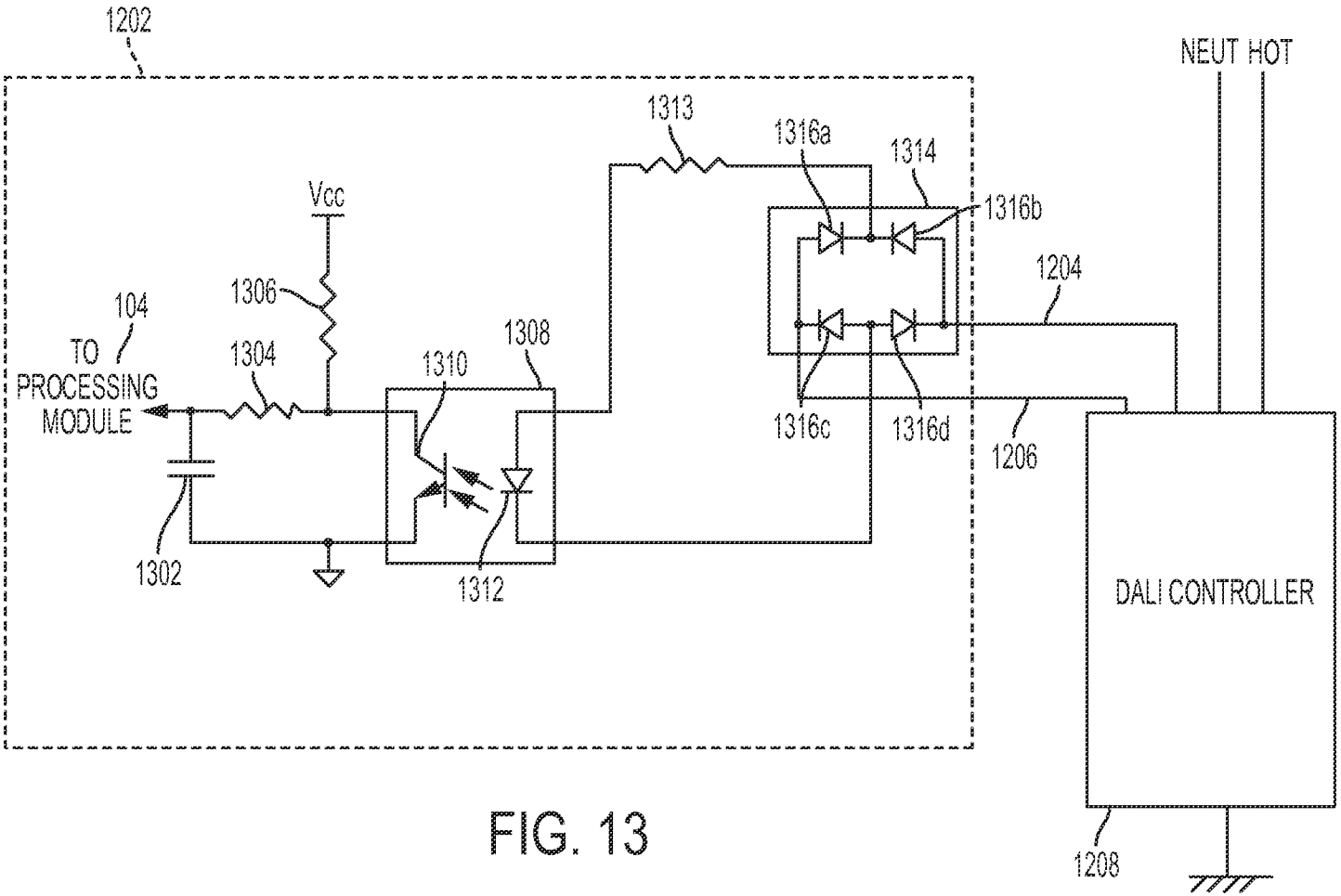
FIG. 13 is a partial schematic diagram illustrating an example of the DALI interface of the lighting control device depicted in FIG. 12.

FIG. 13 is a partial schematic diagram illustrating an example of the DALI interface 1202 of the lighting control device 1200. The DALI interface 1202 can include a filter capacitor 1302, a filter resistor 1304, a pull-up resistor 1306, an opto-coupler 1308 with a phototransistor 1310 and a light-emitting diode 1312, a current-limiting resistor 1313, and a bridge rectifier 1314 with diodes 1316*a-d*.

The bridge rectifier 1314 is a component of a DALI receiver circuit. The bridge rectifier 1314 allows the receiver circuit to be polarity independent in accordance with the DALI specification. Polarity independence allows the receiver to function properly regardless of which of the wires 1204, 1206 is positive compared to the other.

The implementation of the DALI interface 1202 depicted in FIG. 13 is provided for purposes of illustration. Other implementations are possible. For example, the DALI interface 1202 can include any circuitry suitable for converting a high-voltage waveform from the DALI controller 1208 into a low-voltage waveform that can be used by the processing module 104.

The opto-coupler 1308 can communicatively couple the processing module 104 to the DALI controller 1208. The opto-coupler 1308 can also provide electrical isolation between the DALI controller 1208 and the processing module 104. For example, the light-emitting diode 1312 can emit light in response to a current from the DALI controller 1208 passing through the light-emitting diode 1312. The emitted light can selectively activate the phototransistor 1310 (or another suitable photosensor) such that a current flows through the phototransistor 1310. The current flowing through the phototransistor 1310 can have a waveform that corresponds to the signal from the DALI controller 1208. The corresponding waveform can provide data to the processing module 104 that is the same as or similar to the data encoded in the signal outputted by the DALI controller 1208.

The pull-up resistor 1306 can be coupled to a suitable power supply (labeled "VCC" in FIG. 13) such that the waveform of the generated signal is at a sufficiently high voltage level for use by the processing module 104.

An RC filter that includes the filter capacitor 1302 and the filter resistor 1304 can filter a signal that the DALI interface 1202 generates from a control signal, which is received from the DALI controller 1208. For example, the RC filter can reduce noise or other undesirable signal components in the generated signal.

Figure 14:
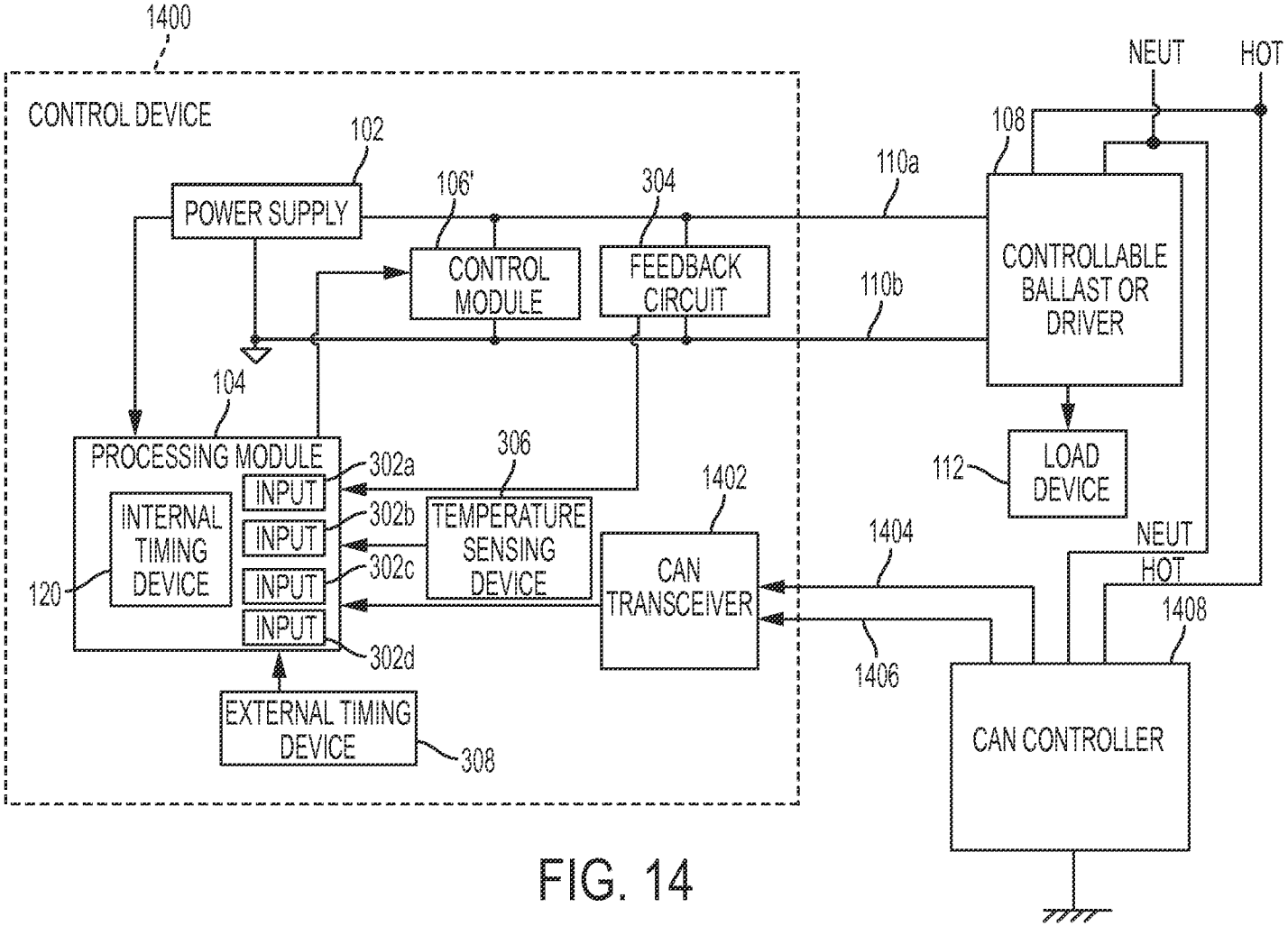
FIG. 14 is a block diagram illustrating an example of a lighting control device that can be used with a controller area network ("CAN") controller.

In additional or alternative aspects, a lighting control device can communicate with other types of external control devices. For example, FIG. 14 is a block diagram illustrating an example of a lighting control device 1400 that can be used with a controller area network ("CAN") controller 1408. The lighting control device 1400 can be implemented using any aspects of the lighting control device 100 described above with respect to FIGS. 1-7. The lighting control device 1400 can be electrically coupled with the CAN controller 1408 via a CAN transceiver 1402 that is connected to wires 1404, 1406, which provide a CAN bus.

Figure 15:
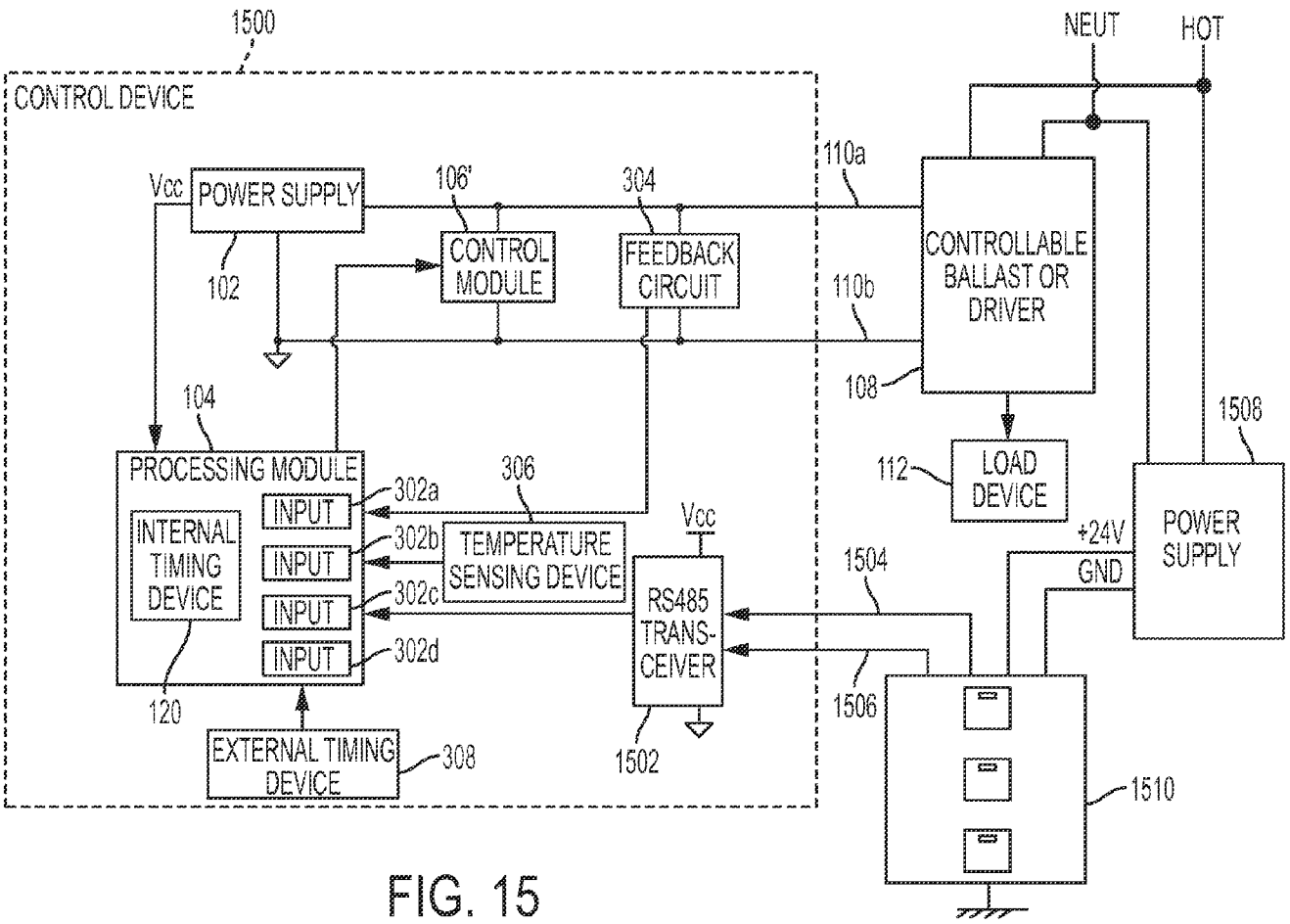
FIG. 15 is a block diagram illustrating an example of a lighting control device with a RS485 transceiver that can be used with a button station controller.

As another example, FIG. 15 is a block diagram illustrating a lighting control device 1500 with a RS485 transceiver 1502 that can be used with a button station controller 1510. The lighting control device 1500 can be implemented using any aspects of the lighting control device 100 described above with respect to FIGS. 1-7.

The lighting control device 1500 can be communicatively coupled with the button station controller 1510 via the RS485 transceiver 1502. The RS485 transceiver 1502 can be connected to wires 1504, 1506. The wires 1504, 1506 (e.g., CAT 5 twisted pair lines) can provide a communication bus from the button station controller 1510 to the lighting control device 1500. The communication bus can be used to communicate signals using the RS-485 protocol. Examples of these signals include specific control signals for use with a lighting device (e.g., increase or decrease dimming, activate or deactivate the lighting device, etc.). Differential signaling can be used by the button station controller 1510 to communicate these signals.

The button station controller 1510 can be powered by a power supply 1508, such as (but not limited to) a 120/277 Vac to 24 V power supply.

Figure 16:
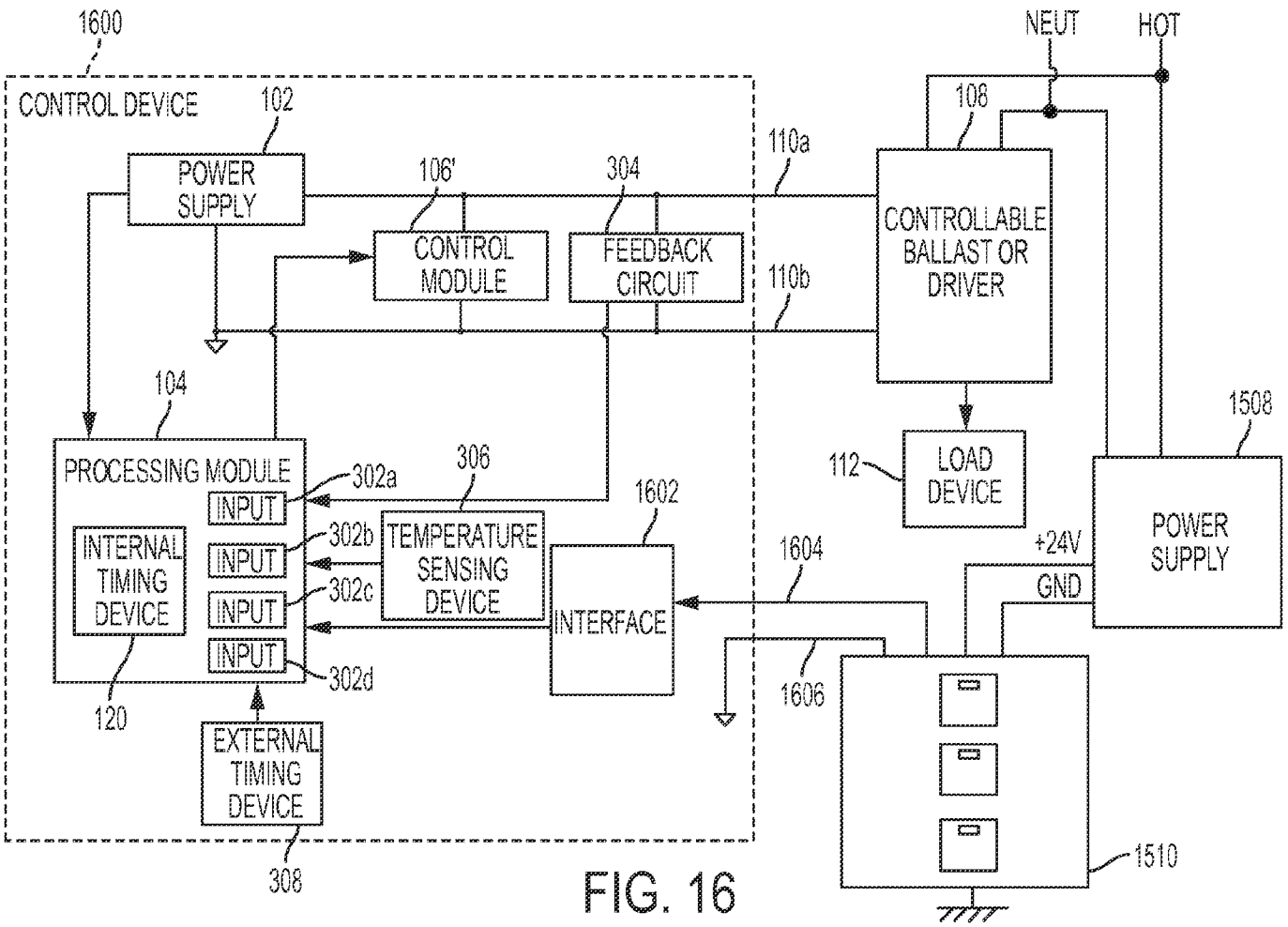
FIG. 16 is a block diagram illustrating another example of a lighting control device that can be used with a button station controller.

FIG. 16 is a block diagram illustrating another example of a lighting control device 1600 that can be used with the button station controller 1510. The lighting control device 1600 can be electrically coupled with the button station controller 1510 with an interface 1602 that is connected to wires 1604, 1606.

Figure 17:
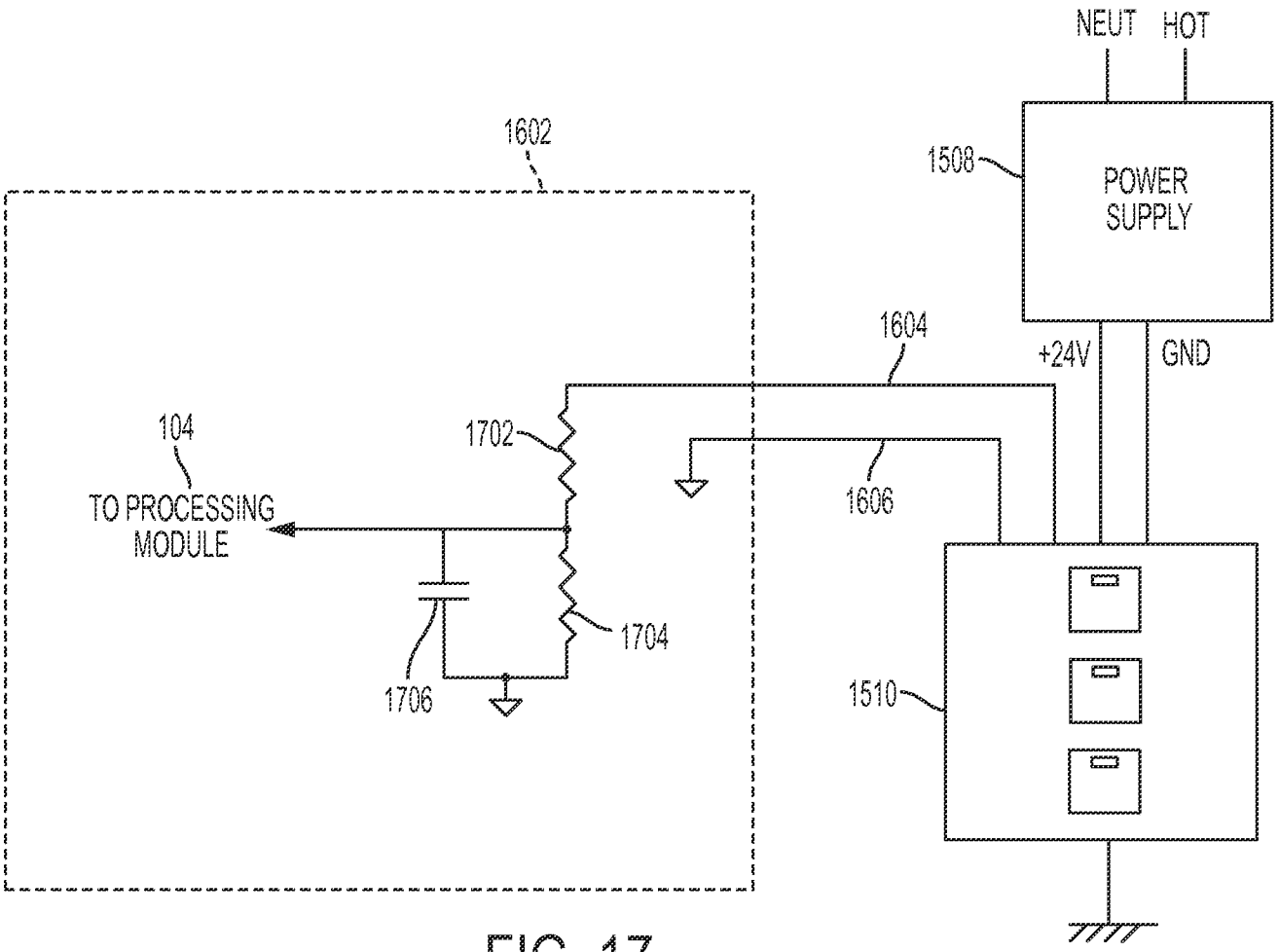
FIG. 17 is a partial schematic diagram illustrating an example of the interface of the lighting control device depicted in FIG. 16.

FIG. 17 is a partial schematic diagram illustrating an example of the interface 1602. The interface 1602 can include resistors 1702, 1704 that provide a voltage divider and a filter capacitor 1706. A voltage drop provided by the voltage divider can decrease the voltage of the signal received from the button station controller 1510. An electrical connection to the voltage divider at a point between the resistors 1702, 1704 can be used to provide a low-voltage signal to any suitable input of the processing module 104 (e.g., the input 302*c*, as depicted in FIG. 16). The filter capacitor 1706 can provide suitable filtering for the low-voltage signal.

The implementation of the interface 1602 depicted in FIG. 17 is provided for purposes of illustration. Other implementations are possible. For example, the filter interface can include any circuitry suitable for converting a high-voltage waveform from the button station controller 1510 into a low-voltage waveform that can be used by the processing module 104.

Figure 18:
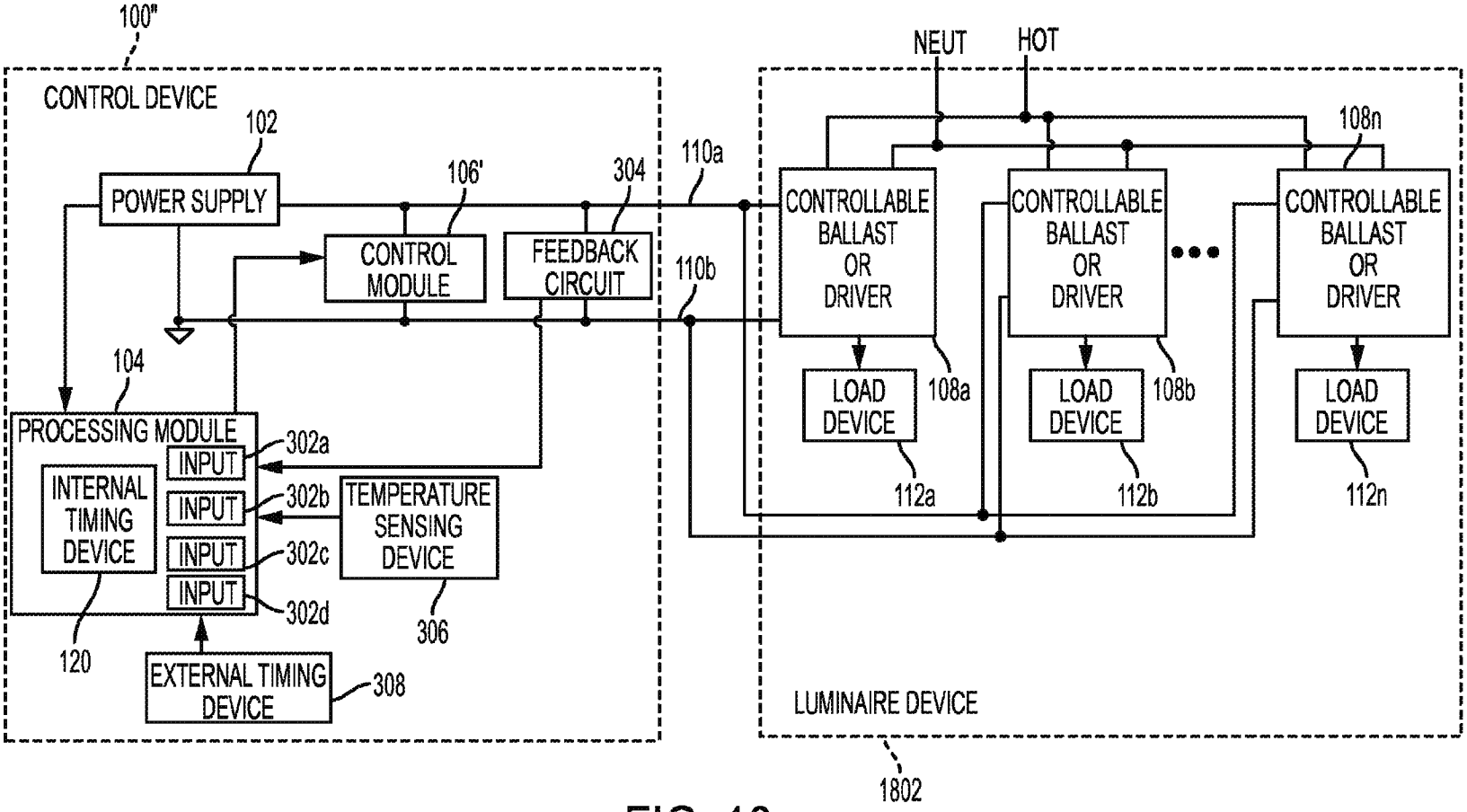
FIG. 18 is a block diagram illustrating an example of a lighting control device being powered using multiple drivers in a luminaire device.

For illustrative purposes, the lighting control device has been described above as being powered by a single controllable ballast or driver 108. However, any number of controllable ballasts or drivers can be used with a lighting control device. For example, FIG. 18 is a block diagram illustrating an example of a lighting control device being powered using multiple drivers in a luminaire device 1802. The luminaire device 1802 depicted in FIG. 18 includes multiple controllable ballasts or drivers 108*a-n* that are respectively used with load devices 112*a-n*. The controllable ballasts or drivers 108*a-n* can be electrically connected in parallel with one another to the leads 110*a*, 110*b*. A combined current from the controllable ballasts or drivers 108*a-n* can be provided to the power supply 102. The power supply 102 can use the current to power the processing module 104, as described above with respect to FIGS. 1-7.

Figure 19:
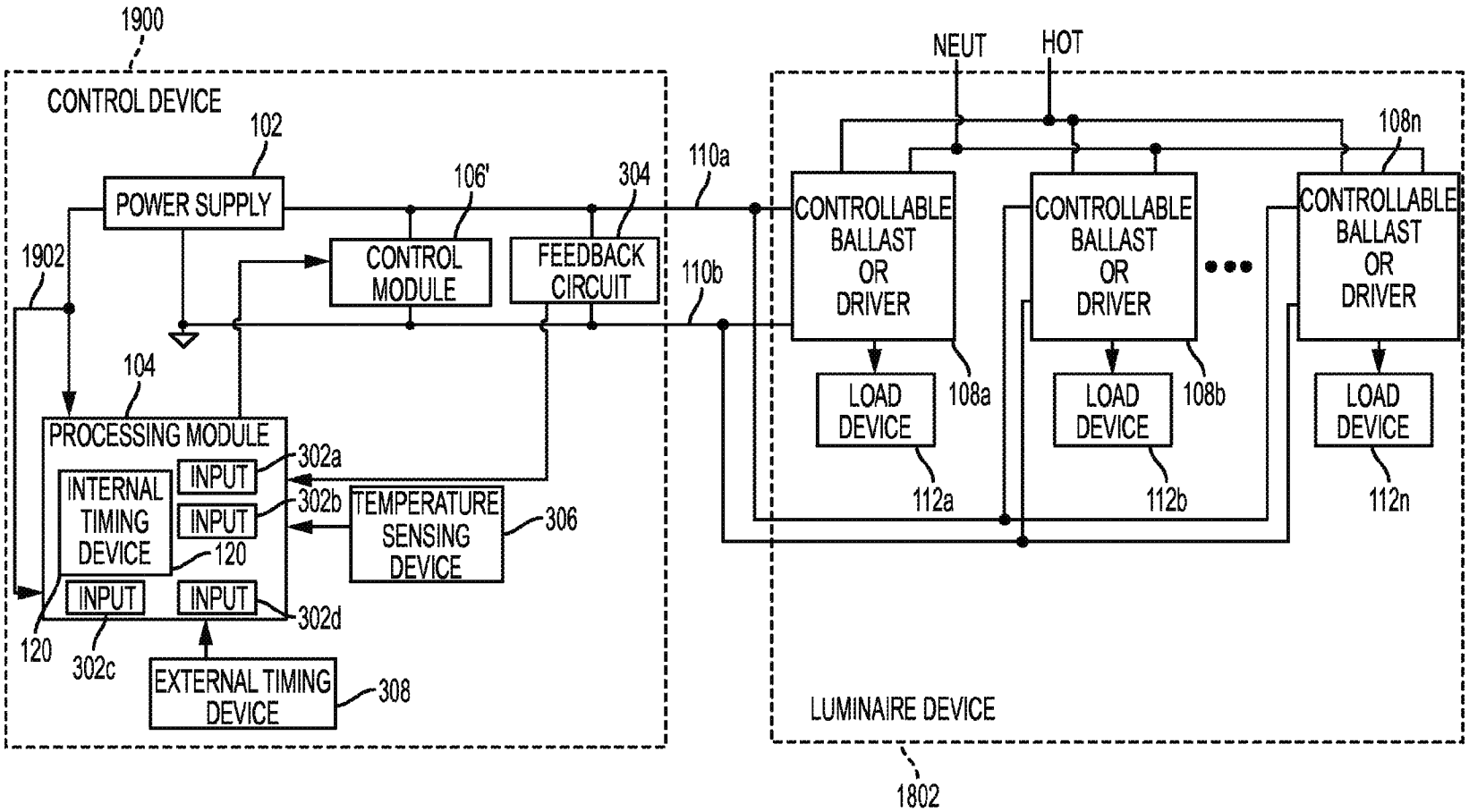
FIG. 19 is a block diagram illustrating an example of a lighting control device being powered using multiple drivers in a luminaire device and using voltage feedback to determine that sufficient power is available to avoid a sleep mode or other low-power mode.

In some aspects, the lighting control device can include feedback circuitry that can be used to prevent the processing module 104 from entering a "sleep" or other low power mode if sufficient power is available to the lighting control device. For example, FIG. 19 is a block diagram illustrating an example of a lighting control device 1900 being powered using multiple drivers in a luminaire device 1802 and using voltage feedback 1902 to determine that sufficient power is available to avoid a sleep mode or other low-power mode.

The voltage feedback 1902 can be coupled to the processing module at input 302*c* or another suitable input. The processing module 104 can use a voltage present at the input 302*c* to determine an amount of power available from the luminaire device 1802. For example, a feedback voltage above a specified threshold can indicate that multiple controllable ballasts or drivers 108*a-n* are connected in parallel to the lighting control device 1900 via the leads 110*a*, 110*b*. The processing module 104 can determine that a sleep or other low-power mode is not necessary based on the feedback voltage being above the specified threshold.

Figure 20:
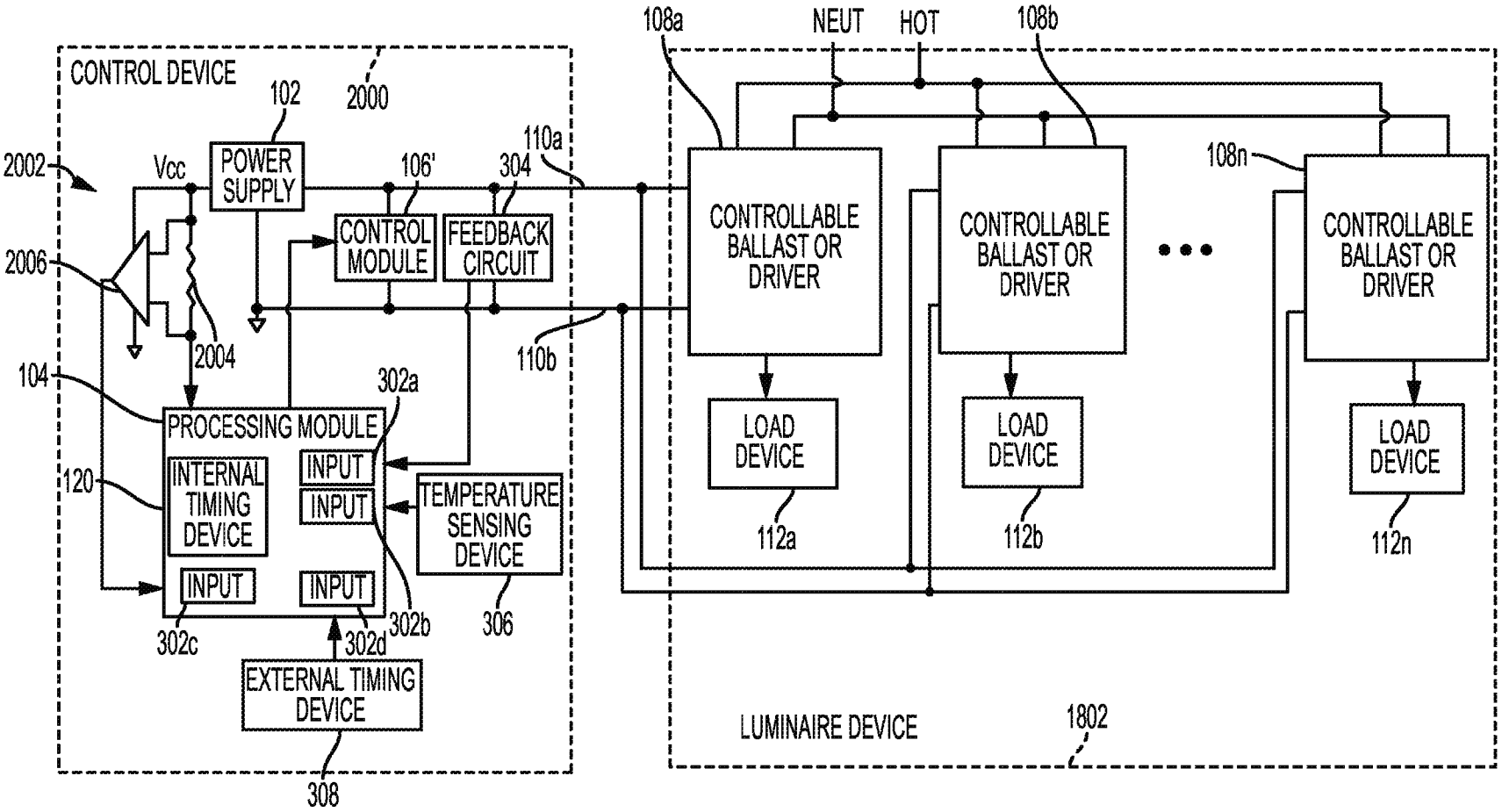
FIG. 20 is a block diagram illustrating an example of a lighting control device being powered using multiple drivers in a luminaire device and using current feedback to determine that sufficient power is available to avoid a sleep mode or other low-power mode.

Additionally or alternatively, a feedback current can be used to prevent the processing module 104 from entering a "sleep" or other low power mode if sufficient power is available. For example, FIG. 20 is a block diagram illustrating an example of a lighting control device being powered using multiple drivers in a luminaire device 1802 and using current feedback circuitry 2002 to determine that sufficient power is available to avoid a sleep mode or other low-power mode. The current feedback circuitry 2002 can include a current sense resistor 2004 and an operational amplifier 2006. The processing module 104 can use a voltage outputted by the operational amplifier 2006 to determine an amount of power available from the luminaire device 1802. The voltage outputted by the operational amplifier 2006 represents a scaled current that is measured by the operational amplifier 2006 through the sense resistor 2004. A current above a specified threshold can indicate that multiple controllable ballasts or drivers 108*a-n* are connected in parallel to the lighting control device 1900 via the leads 110*a*, 110*b*. The processing module 104 can determine that a sleep or other low-power mode is not necessary based on the feedback current being above the specified threshold.

Figure 21:
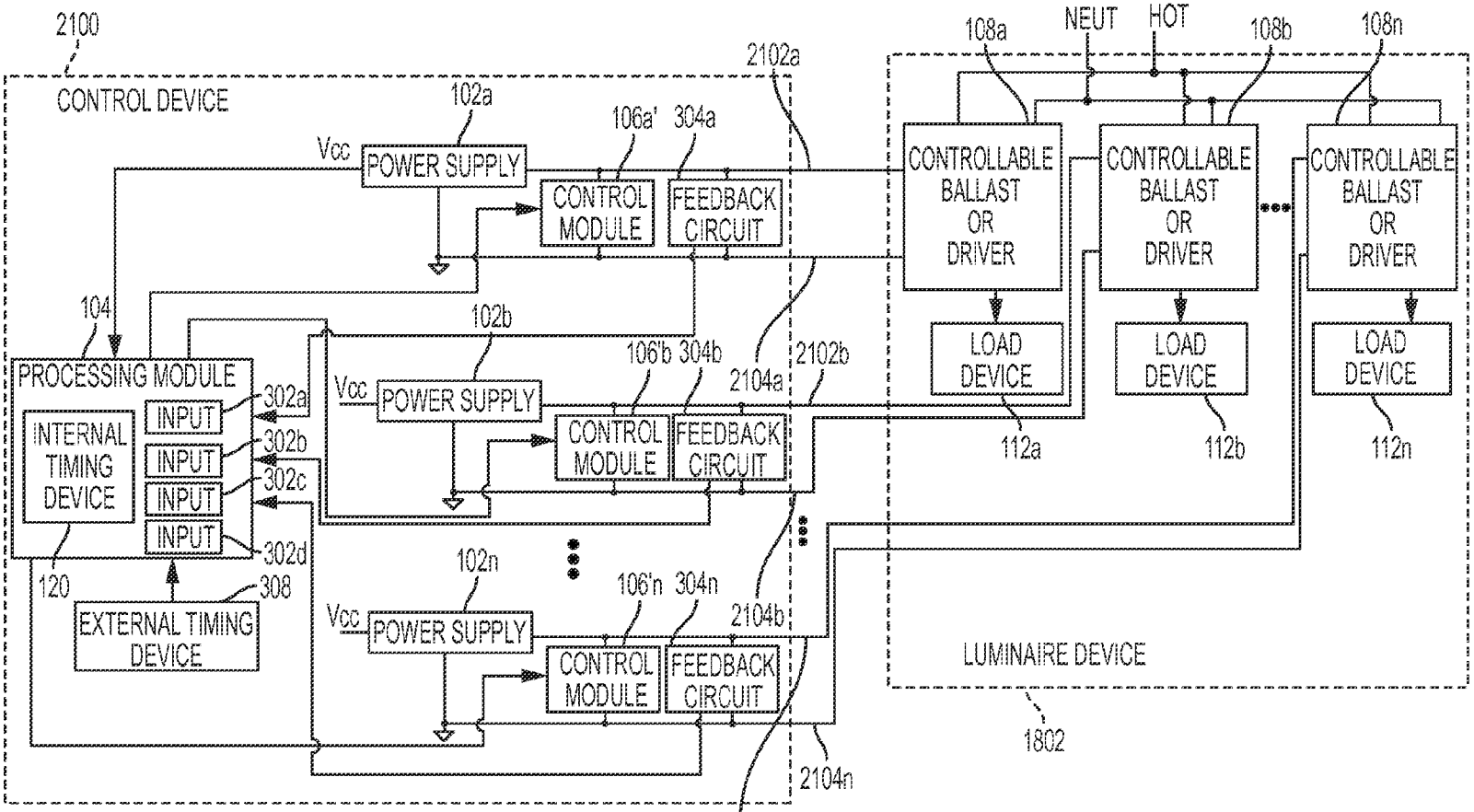
FIG. 21 is a block diagram illustrating an alternative example of a lighting control device being powered using multiple drivers in a luminaire device.

In additional or alternative aspects, a lighting control device can include multiple power supplies that are respectively connectable to multiple drivers. For example, FIG. 21 is a block diagram illustrating an example of a lighting control device 2100 being powered using multiple drivers in a luminaire device 1802. The lighting control device 2100 can include power supplies 102*a-n*, control modules 106*a-n*, and feedback circuits 304*a-n*. Each of the controllable ballasts or drivers 108*a-n* can be electrically coupled to a respective one of the control modules 106*a-n* and a respective one of the feedback modules 304*a-n*. The electrical coupling can be provided by respective pairs of leads 2102*a-n*, 2104*a-n*. Each of the power supplies 102*a-n* can output a respective current to a common power bus (e.g., the bus labeled "VCC" in FIG. 21) in the lighting control device 2100. The combined current provided via the common power bus can be used to power the processing module 104.

In some aspects, the lighting control device 2100 can independently control each of the controllable ballasts or drivers 108*a-n* using different control interfaces, which are provided by the leads 2102*a-n*, 2104*a-b*. For example, the leads 2102*a*, 2104*a* can provide a first control interface similar to the control interface provided by the leads 110*a*, 110*b* described above with respect to FIGS. 1-7, the leads 2102*b*, 2104*b* can provide a second control interface similar to the control interface provided by the leads 110*a*, 110*b*, etc. The lighting control device 2100 can modify a first control voltage across the first control interface (e.g., the leads 2102*a*, 2104*a*) independently of how the lighting control device 2100 modifies a second control voltage across the second control interface (e.g., the leads 2102*b*, 2104*b*). The combined power provided using multiple controllable ballasts or drivers 108*a-n* in a luminaire device 1802 can be sufficient to support a higher processing capacity that may be required for independently controlling different ballasts or drivers 108*a-n*.

Figure 22:
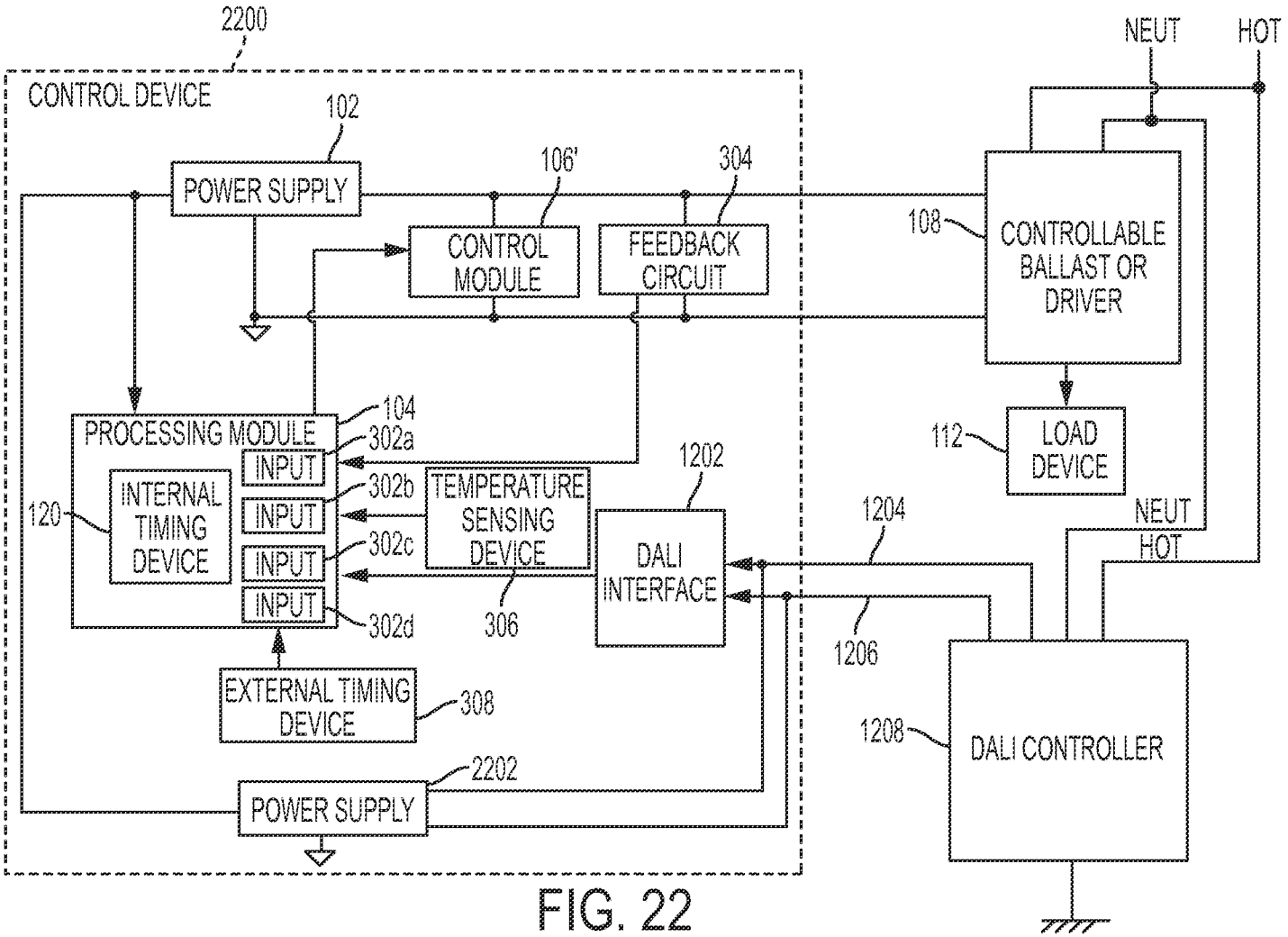
FIG. 22 is a block diagram illustrating an example of a lighting control device using a DALI controller as an additional power source.

In additional or alternative aspects, a lighting control device can be powered using a luminaire in combination with an external control device. For example, FIG. 22 is a block diagram illustrating an example of a lighting control device 2200 using a DALI controller 1208 as an additional power source. A power supply 2202 in the lighting control device 2200 can be electrically coupled to the DALI controller 1208 via the wires 1204, 1206. The power supply 2202 can output a first current and the power supply 102 can output a second current. The combined first and second currents can be provided to the processing module 104 to power the processing module 104.

Figure 23:
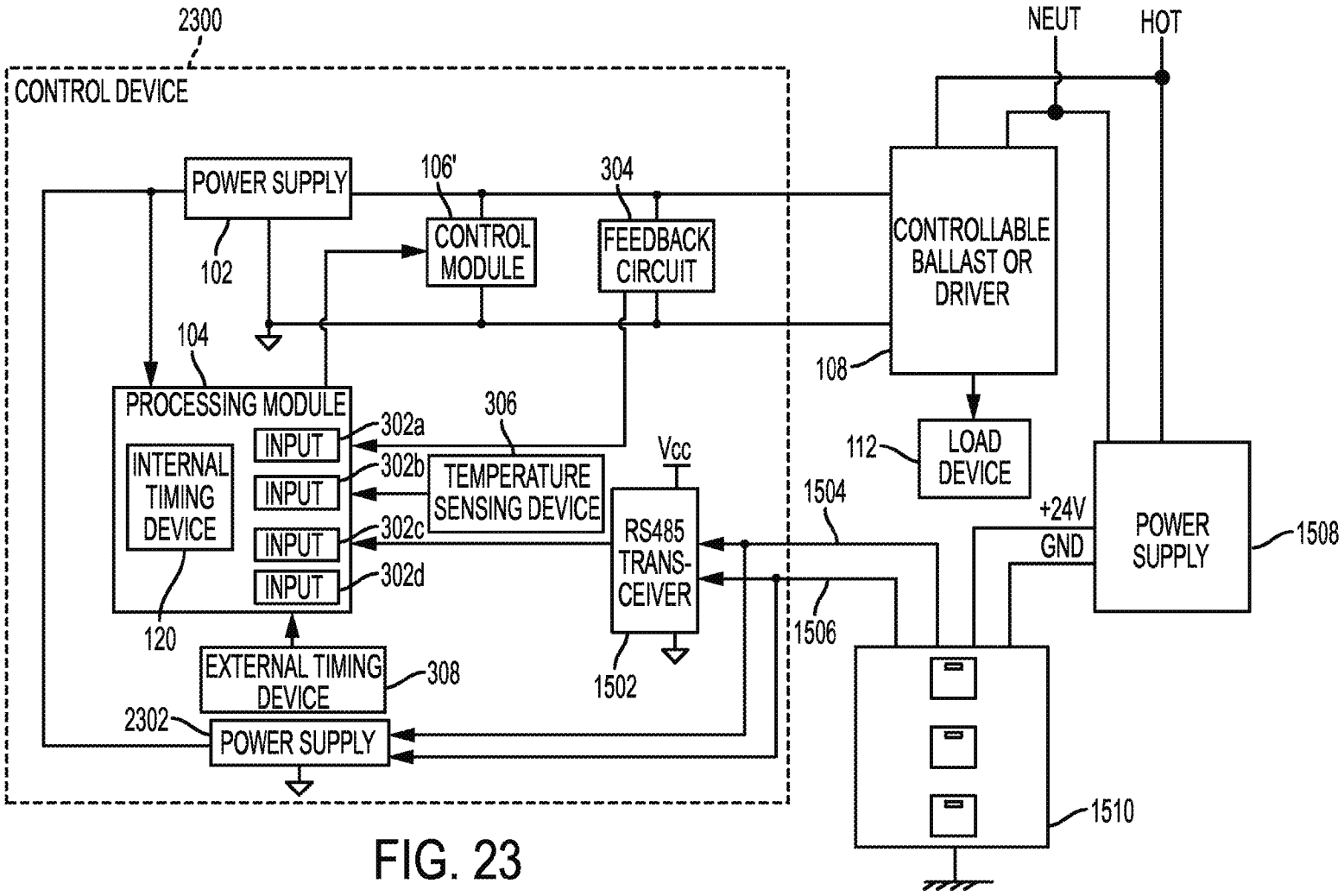
FIG. 23 is a block diagram illustrating an example of a lighting control device that can harvest power from an RS485 communication bus.

In additional or alternative aspects, other external control devices can be used to power the lighting control device. For example, FIG. 23 is a block diagram illustrating an example of a lighting control device 2300 that uses a power supply 2302 to harvest power from an RS485 communication bus. RS485 networks may be configured with a fail-safe bias at each end. The fail-safe bias can ensure that a differential signal voltage (e.g., between the wires 1504, 1506 used to communicate data) is greater than 200 mV above common when there is no communication on the wires 1504, 1506.

In some aspects, the RS485 fail-safe bias can be used to provide a small amount of current (e.g., less than 1 mA) from the RS485 communication bus to a lighting control device 2300 using the power supply 2302. The amount of current can be small enough to avoid interrupting or otherwise negatively impacting communication on the RS485 network. The amount of current obtained from the RS485 communication bus using the power supply 2302 can be large enough to provide supplemental power to the control. For example, combined currents from the power supply 2302 and the power supply 102 can be provided to the processing module 104, thereby powering the processing module 104.

Figure 24:
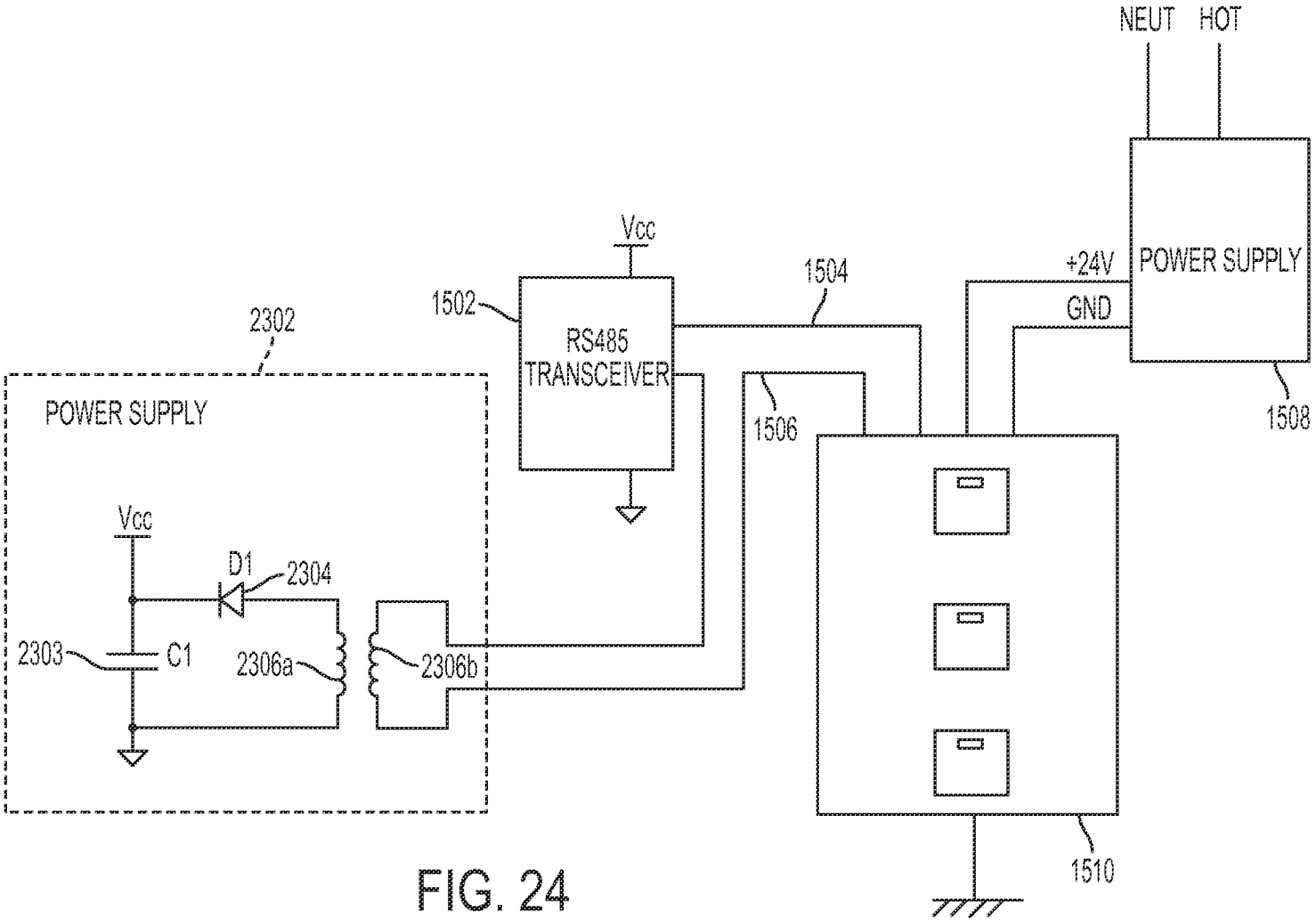
FIG. 24 is a partial schematic diagram illustrating an example of a power supply that can be used in a lighting control device to harvest power from an RS485 communication bus.

The power supply 2302 can be implemented in any suitable manner. For example, FIG. 24 is a partial schematic diagram illustrating an example of a power supply 2302 that can be used in a lighting control device to harvest power from an RS485 communication bus. The power supply 2302 can include a capacitor 2303, a diode 2304, and a transformer that includes coupled inductors 2306*a*, 2306*b*.

The capacitor 2303, the diode 2304, and the coupled inductors 2306*a*, 2306*b* can be used to couple energy from the RS485 communication bus to a lighting control device. The inductor 2306*b* can be electrically connected to the button station controller 1510 via wires 1504, 1506. During communication, when the RS485 communication bus (e.g., wires 1504, 1506) is active, electrical current that is used to communicate RS485 signals flows through the inductor 2306*b*, which is electrically connected to the wire 1506. The inductor 2306*b* can induce an electrical current in the inductor 2306*a*. The small amount of current flowing through the inductor 2306*b* is thereby coupled to the inductor 2306*a* for use by the lighting control device. The current induced in the inductor 2306*a* of the power supply 2302 can be provided to the processing module of the lighting control device. In this manner, the power from the RS485 communication bus is available for powering the processing module.

The implementation of a power supply 2302 depicted in FIG. 24 is provided for illustrative purposes only. Other implementations are possible. Other examples of a power supply 2302 include one or more of a small switching circuit, a voltage doubling circuit, a coupling circuit (e.g., an opto-coupler or magnetic coupler) with a regulator to provide a regulated 3.3V output from the RS485 communication bus.

Figure 25:
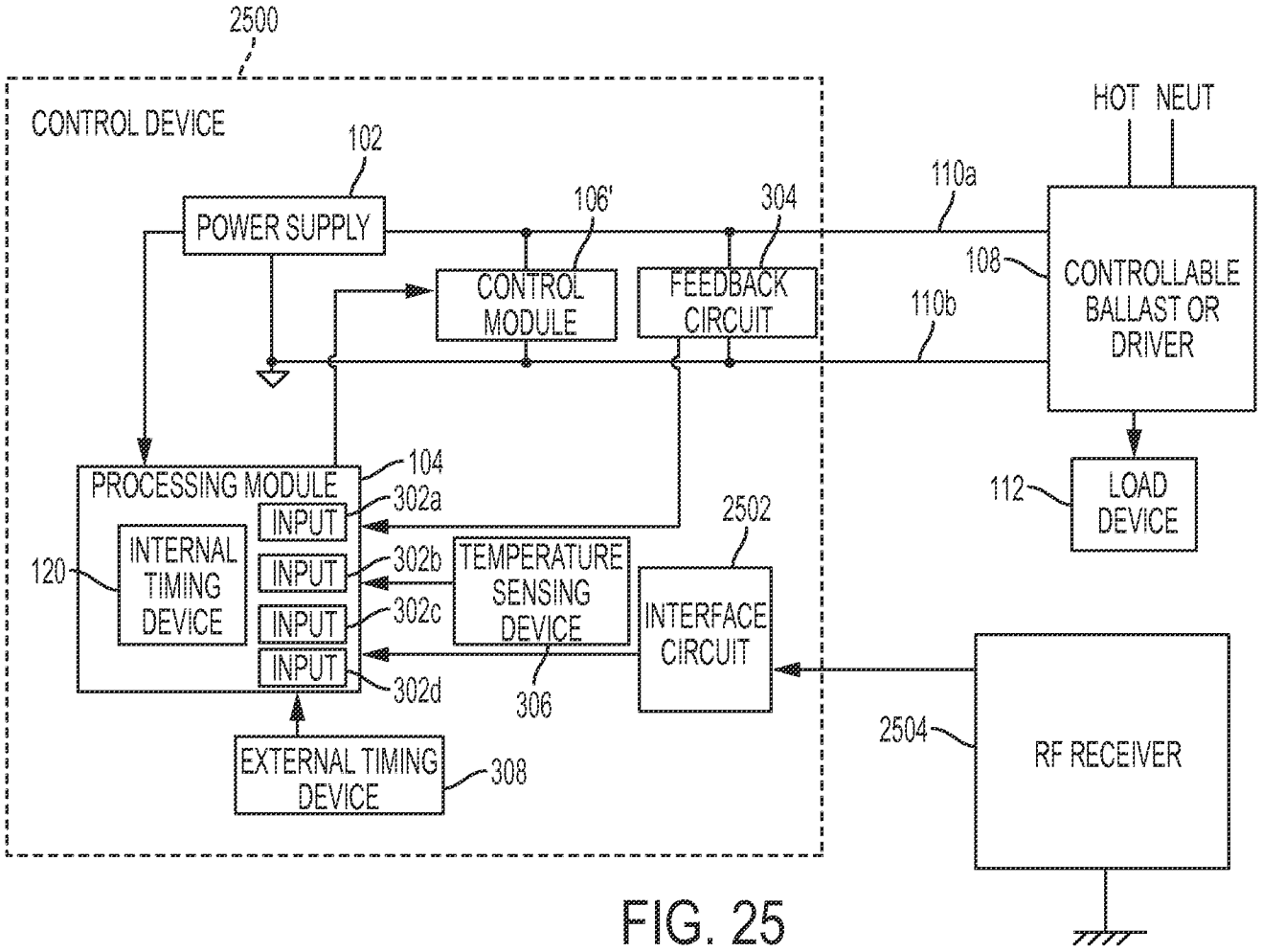
FIG. 25 is a block diagram illustrating an example of a lighting control device that is communicatively coupled with an external RF receiver module.

FIG. 25 is a block diagram illustrating an example of a lighting control device 2500 that is communicatively coupled with an external RF receiver module 2504 via an interface circuit 2502. The RF receiver module 2504 can receive control signals from an RF transmitter using any suitable protocol (e.g., Bluetooth, ZigBee, Z-Wave, etc.). The processing module 104 can cause a control voltage across leads 110*a*, 110*b* to be modified based on the control signals received via the RF receiver module 2504.

Figure 26:
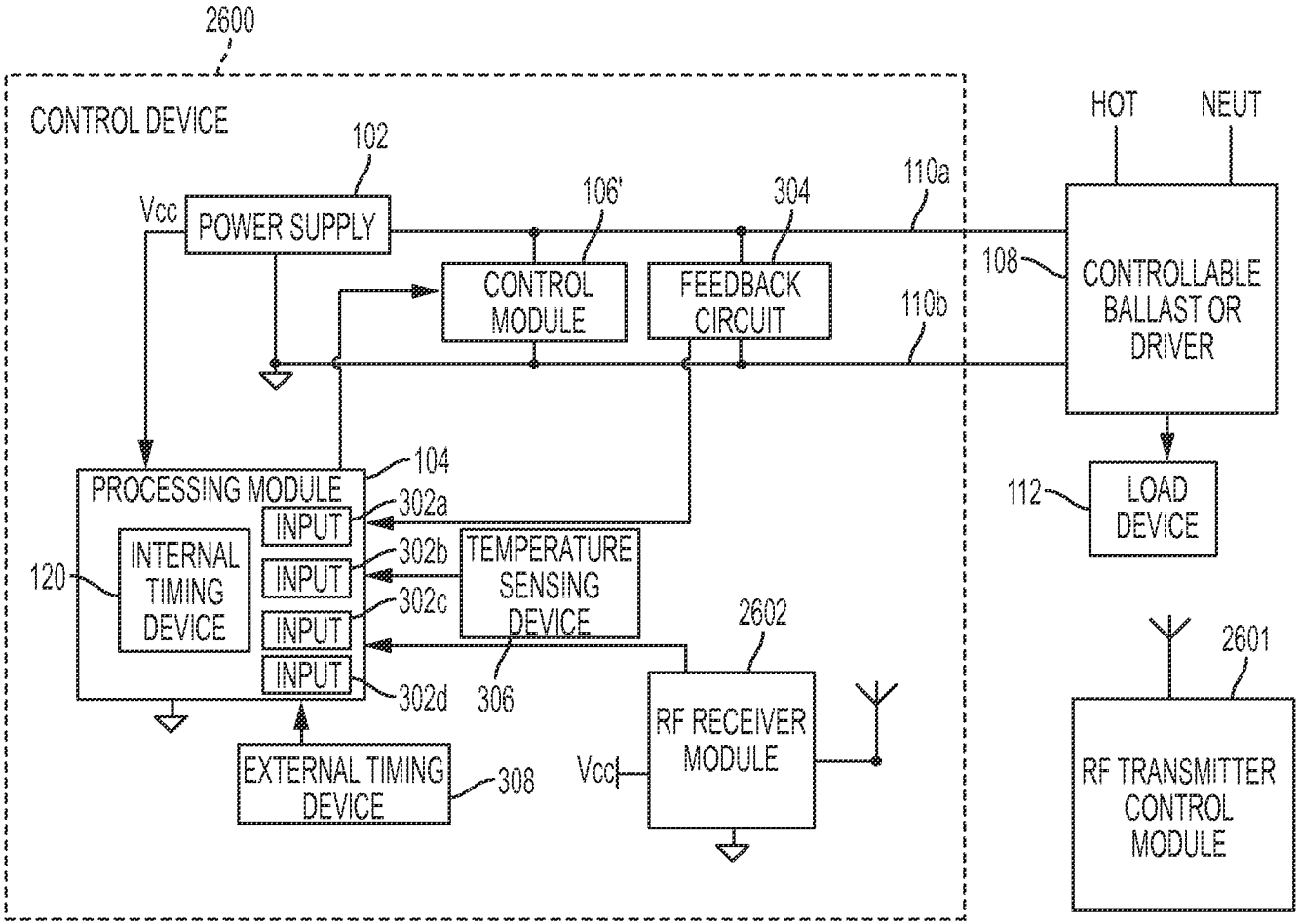
FIG. 26 is a block diagram illustrating an example of a lighting control device having an RF transceiver for communicating with an external RF transmitter.

In some aspects, as depicted in FIG. 26, a wireless RF receiver module 2602 can be integrated with a lighting control device 2600. The RF receiver module 2602 can be used to communicate with an external RF transmit control module 2601. The RF receiver module 2602 can receive control signals from an RF transmitter using any suitable protocol (e.g., Bluetooth, ZigBee, Z-Wave, etc.). The processing module 104 can cause a control voltage across leads 110*a*, 110*b* to be modified based on the control signals received via the RF receiver module 2602.

Figure 27:
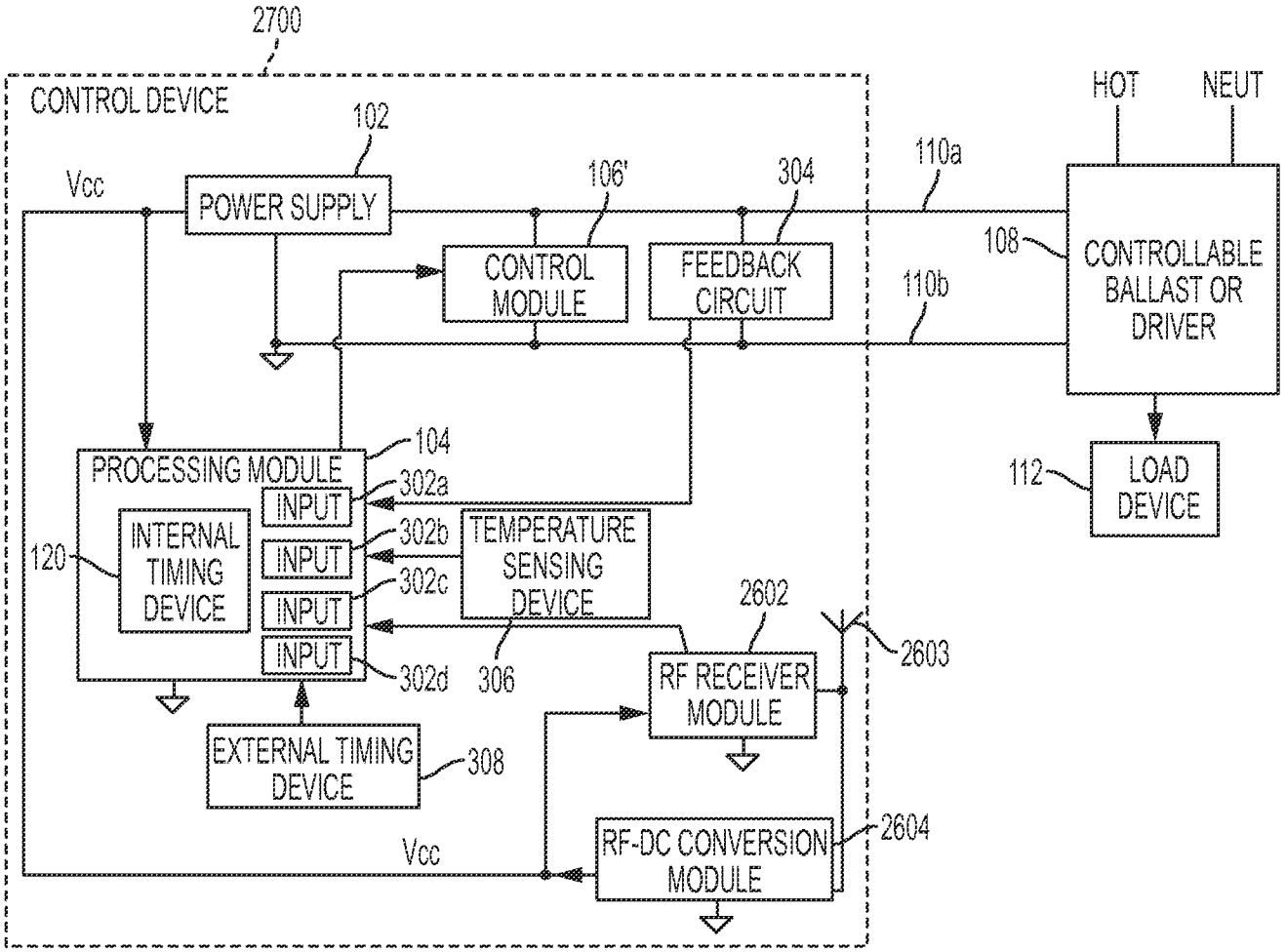
FIG. 27 is a block diagram illustrating an example of a lighting control device that can harvest energy from RF signals.

FIG. 27 is a block diagram illustrating an example of a lighting control device 2700 that can harvest energy from RF signals. An RF receiver module 2602 of the lighting control device 2600 can receive RF signals via the antenna 2603 (e.g., signal transmitted by an external RF transmit control module 2601). An RF-DC conversion module 2604 can also be coupled to the antenna 2603. The RF-DC conversion module 2604 can convert RF energy into electrical energy. The RF-DC conversion module 2604 can output a current that can be used to power one or more of the RF receiver module 2602 and the processing module 104.

Figure 28:
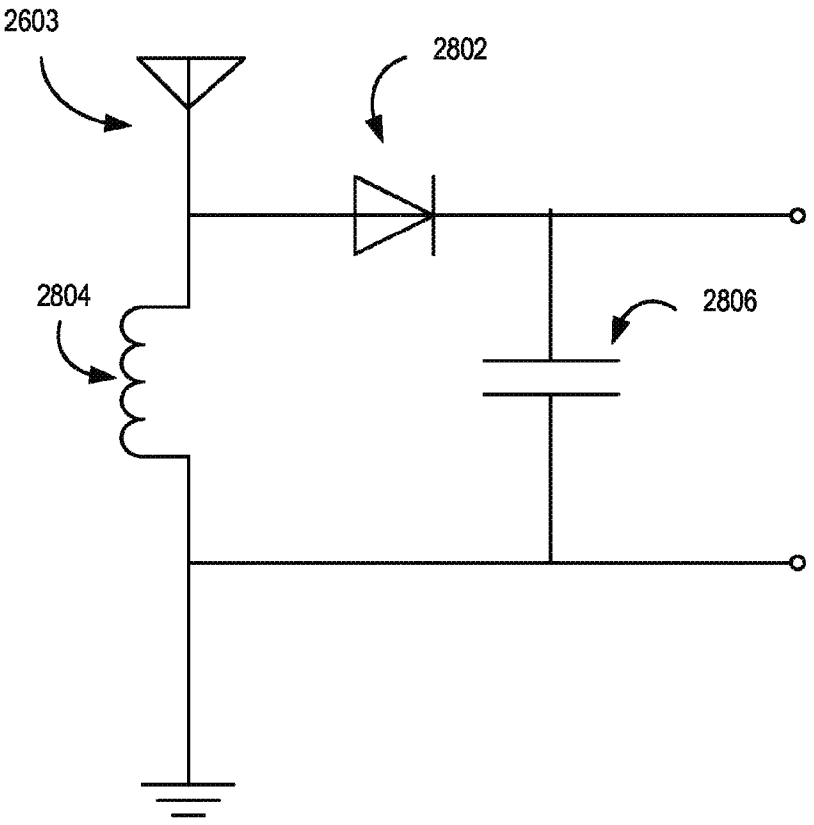
FIG. 28 is a schematic diagram illustrating another example an RF energy harvesting circuit that can be used in a lighting control device.

FIG. 28 is a schematic diagram illustrating another example an RF energy harvesting circuit that can be used in a lighting control device. The RF energy harvesting circuit can include a diode 2802, an inductor 2804, and a capacitor 2806. Current flowing through the antenna 2603 can be provided to a processing module 104 via the diode 2802. The antenna 2603 and the inductor 2804 can be tuned for a specific carrier frequency, which can minimize the impedance and maximize the reception of the RF energy harvesting circuit. The current through the 2802 blocking diode can charge the output capacitor 2806 when a voltage across the tuned inductor 2804 exceeds a voltage across the storage capacitor 2806. In this manner, the energy from RF signals received by the antenna 2603 is stored in the storage capacitor 2806. The stored energy may be further regulated with a low dropout voltage regulator.

The foregoing is provided for purposes of illustrating, describing, and explaining aspects of the present invention and is not intended to be exhaustive or to limit the invention to the precise forms disclosed. Further modifications and adaptation to these embodiments will be apparent to those skilled in the art and may be made without departing from the scope and spirit of the invention.

What is claimed is:

1. A control device comprising:

a control module configured to provide a driving signal that is adapted for modifying a control voltage on a 0-10 volt control bus;

a processing module configured to determine a duty cycle of the driving signal, wherein the processing module is configured to receive power via the 0-10 volt control bus and has a power requirement less than or equal to a power available via the 0-10 volt control bus; and an interface configured to convert signals received from an external control device to a voltage level usable by the processing module.

2. The control device of claim 1, wherein the control module and the processing module are included in a low-power microprocessor, wherein the low-power microprocessor is configured to receive power via the 0-10 volt control bus and has a power requirement less than or equal to a power available via the 0-10 volt control bus.

3. The control device of claim 2, further comprising a regulating device, wherein the regulating device is configured to modify the control voltage by sinking a current provided via the 0-10 volt control bus, wherein the driving signal is configured to control the sinking of the current by modulating a load current of the regulating device.

4. The control device of claim 2, wherein the control module comprises a pulse-width modulation signal generator.

5. The control device of claim 1, wherein the interface is configured to generate a first voltage signal with an amplitude less than or equal to 3.3 volts from a second voltage signal received from the external control device.

6. The control device of claim 5, wherein the interface is configured to receive the second signal from at least one of a phase dimmer device and a 0-10 volt dimmer device.

7. The control device of claim 6, wherein the interface comprises a coupler configured to communicatively couple the control device to at least one of the phase dimmer device and the 0-10 volt dimmer device and to electrically isolate the processing module from at least one of the phase dimmer and the 0-10 volt dimmer device.

8. The control device of claim 7, wherein the interface further comprises an RC filter electrically connected between the coupler and the processing module, wherein the RC filter is configured to filter reduced-voltage signals generated in response to the second signal being received by the coupler.

9. The control device of claim 5, wherein the interface is configured to receive the second signal from at least one of a 0-10 volt dimmer device and a button station controller.

10. The control device of claim 9, wherein the interface comprises a voltage divider configured to generate reduced-voltage signals from the second signal that are received from at least one of the 0-10 volt dimmer device and the button station controller.

11. The control device of claim 5, wherein the interface is configured to receive the second signal from a Digital Addressable Lighting Interface controller.

12. The control device of claim 11, wherein the interface comprises a bridge rectifier configured to be electrically coupled to the Digital Addressable Lighting Interface controller.

13. The control device of claim 12, wherein the interface further comprises a coupler electrically coupled to the output of the bridge rectifier and configured to electrically isolate the processing module from the Digital Addressable Lighting Interface controller.

14. The control device of claim 13, wherein the interface further comprises an RC filter electrically connected between the coupler and the processing module, wherein the RC filter is configured to filter reduced-voltage signals generated in response to the second signal being received by the coupler.

15. The control device of claim 1, wherein the interface is configured to receive the signals from an RS485 transceiver.

16. The control device of claim 15, further comprising a power supply electrically connected to the processing module in parallel with the interface, wherein the power supply is configured to provide, to the processing module, electrical power that is received from the RS485 transceiver.

17. The control device of claim 1, wherein the interface is configured to receive the signals from an RF device.

18. The control device of claim 17, further comprising an RF-to-DC converter electrically coupled to the processing module and configured to:

generate electrical energy from signals received via the interface; and provide the electrical energy to the processing module.

19. The control device of claim 1, wherein the control module is connectable to a plurality of controllable ballasts or drivers and is configured to receive a combined current from a parallel electrical connection including the plurality of controllable ballasts or drivers.

20. The control device of claim 1, further comprising a plurality of control modules electrically connected to the processing module in parallel and configured to provide a combined current to the processing module, wherein each of the control modules is connectable to a respective one of a controllable ballasts or drivers in parallel.

21. The control device of claim 1, wherein the interface is configured to convert the received signals by performing operations that comprise converting a high-voltage control signal received from the external control device to a low-voltage control signal usable by the processing module.

* * * * *